US011410503B2

(12) United States Patent
Nelson et al.

(10) Patent No.: US 11,410,503 B2
(45) Date of Patent: Aug. 9, 2022

(54) GAMING SYSTEM AND METHOD FOR MODIFYING A PLAY OF A TABLE GAME BASED ON A SPORTING EVENT

(71) Applicant: IGT, Las Vegas, NV (US)

(72) Inventors: Dwayne R. Nelson, Las Vegas, NV (US); Jeffrey Knox, Las Vegas, NV (US)

(73) Assignee: IGT, Las Vegas, NV (US)

( * ) Notice: Subject to any disclaimer, the term of this patent is extended or adjusted under 35 U.S.C. 154(b) by 23 days.

(21) Appl. No.: 16/653,559

(22) Filed: Oct. 15, 2019

(65) Prior Publication Data

US 2021/0110669 A1 Apr. 15, 2021

(51) Int. Cl.
*G07F 17/32* (2006.01)

(52) U.S. Cl.
CPC ..... *G07F 17/3288* (2013.01); *G07F 17/322* (2013.01); *G07F 17/3211* (2013.01); *G07F 17/3244* (2013.01)

(58) Field of Classification Search
CPC ..... G07F 17/3288; G07F 17/3211; G07F 17/322; G07F 17/3244
USPC ..... 463/25
See application file for complete search history.

(56) References Cited

U.S. PATENT DOCUMENTS 6,227,544 B1 5/2001 White et al.
6,267,669 B1 7/2001 Luciano et al.
6,565,092 B1 5/2003 McCarthy
7,160,189 B2 1/2007 Walker et al.
7,451,986 B1 11/2008 Thrasher
7,458,891 B2 12/2008 Asher et al.
7,637,807 B2 12/2009 Asher et al.
7,789,754 B2 9/2010 Asher et al.
8,360,842 B2 1/2013 Simon
9,120,006 B2 9/2015 Palmer
10,810,841 B2 * 10/2020 Nelson ..... G07F 17/3209
2004/0066002 A1 4/2004 Spring
2004/0195768 A1 10/2004 Poulos
2005/0245308 A1 * 11/2005 Amaitis ..... G07F 17/34 463/20
2006/0105839 A1 5/2006 Graeve et al.
2006/0105840 A1 5/2006 Graeve
2007/0132183 A1 * 6/2007 Moses ..... A63F 3/00157 273/292
2007/0184888 A1 8/2007 Asher et al.
2007/0197247 A1 8/2007 Inselberg
2008/0032778 A1 2/2008 Amaitis et al.
2008/0042354 A1 * 2/2008 Yoseloff ..... G07F 17/32 273/292

(Continued)

OTHER PUBLICATIONS

"Parameter", Dictionary.com, retrieved from Internet on Jul. 2, 2021 at Internet URL <https://www.dictionary.com/browse/parameter>, p. 1-7. (Year: 2021).*

(Continued)

*Primary Examiner* — Jay Trent Liddle
*Assistant Examiner* — Ryan Hsu
(74) *Attorney, Agent, or Firm* — Neal, Gerber & Eisenberg LLP

(57) ABSTRACT

Gaming systems and methods which utilize the results of a sporting event to modify one or more parameters of a play of a game being played at a gaming table.

20 Claims, 5 Drawing Sheets

(56) References Cited

U.S. PATENT DOCUMENTS

| | | | | |
|---|---|---|---|---|
| 2008/0064467 | A1* | 3/2008 | Reiner | G07F 17/3267 463/16 |
| 2008/0194307 | A1 | 8/2008 | Sanger | |
| 2010/0029381 | A1* | 2/2010 | Vancura | G07F 17/3244 463/30 |
| 2010/0259005 | A1* | 10/2010 | Simon | A63F 1/00 273/292 |
| 2015/0018061 | A1* | 1/2015 | Lee | G07F 17/3218 463/11 |
| 2015/0379816 | A1* | 12/2015 | Hayon | G07F 17/3244 463/25 |
| 2016/0110965 | A1* | 4/2016 | Arnone | G07F 17/326 463/25 |
| 2016/0133088 | A1* | 5/2016 | Givant | G07F 17/3258 463/25 |
| 2019/0180570 | A1 | 6/2019 | Czubak et al. | |

OTHER PUBLICATIONS

"Sport", Merriam-Webster Online Dictionary, retrieved from Internet on Jul. 2, 2021 at Internet URL <https://www.merriam-webster.com/dictionary/sport>, p. 1-14. (Year: 2021).*

* cited by examiner

400

GAMING SYSTEM AND METHOD FOR MODIFYING A PLAY OF A TABLE GAME BASED ON A SPORTING EVENT

TECHNICAL FIELD

The technical field of the present disclosure is that of systems and methods that utilize the results of a sporting event to modify one or more parameters of a play of a game at a gaming table.

BACKGROUND

Players may play games at gaming tables.

BRIEF SUMMARY

In certain embodiments, the present disclosure relates to a system including a processor, and a memory device that stores a plurality of instructions. When executed by the processor responsive to a game parameter modification event occurring in association with an outcome of a sporting event, the instructions cause the processor to modify a parameter of a live table game. When executed by the processor, the instructions cause the processor to receive data associated with a game outcome determined for a play of the live table game. When executed by the processor responsive to any modified parameter of the live table game being associated with the game outcome, the instructions cause the processor to modify the game outcome determined for the play of the live table game, and cause a display, by a display device, of the modified game outcome.

In certain embodiments, the present disclosure relates to a system including a processor, and a memory device that stores a plurality of instructions. When executed by the processor responsive to a game parameter modification event occurring in association with an outcome of a sporting event, the instructions cause the processor to modify, in association with a first player participating in a live table game, a parameter of the live table game, the modification of the parameter of the live table game occurring independent of any modification of the parameter of the live table game associated with a second player participating in the live table game. When executed by the processor for the first player participating in the live table game, the instructions cause the processor to determine a first game outcome for the live table game, and determine a first game award associated with the first game outcome, wherein any of the first game outcome and the first game award are based, at least in part, on the modified game parameter of the live table game. When executed by the processor for the second player participating in the live table game, the instructions cause the processor to determine a second game outcome for the live table game, and determine a second game award associated with the second game outcome, wherein any of the second game outcome and the second game award are determined based, at least in part, on the game parameter of the live table game and independent of the modified game parameter of the live table game.

In certain embodiments, the present disclosure relates to a method of operating a system including, responsive to a game parameter modification event occurring in association with an outcome of a sporting event, modifying, by a processor, a parameter of a live table game. The method also includes receiving data associated with a game outcome determined for a play of the live table game. Responsive to any modified parameter of the live table game being associated with the game outcome, the method includes modifying, by the processor, the game outcome determined for the play of the live table game, and displaying, by the display device, the modified game outcome.

Additional features are described herein, and will be apparent from the following Detailed Description and the figures.

DETAILED DESCRIPTION

Figure 1:
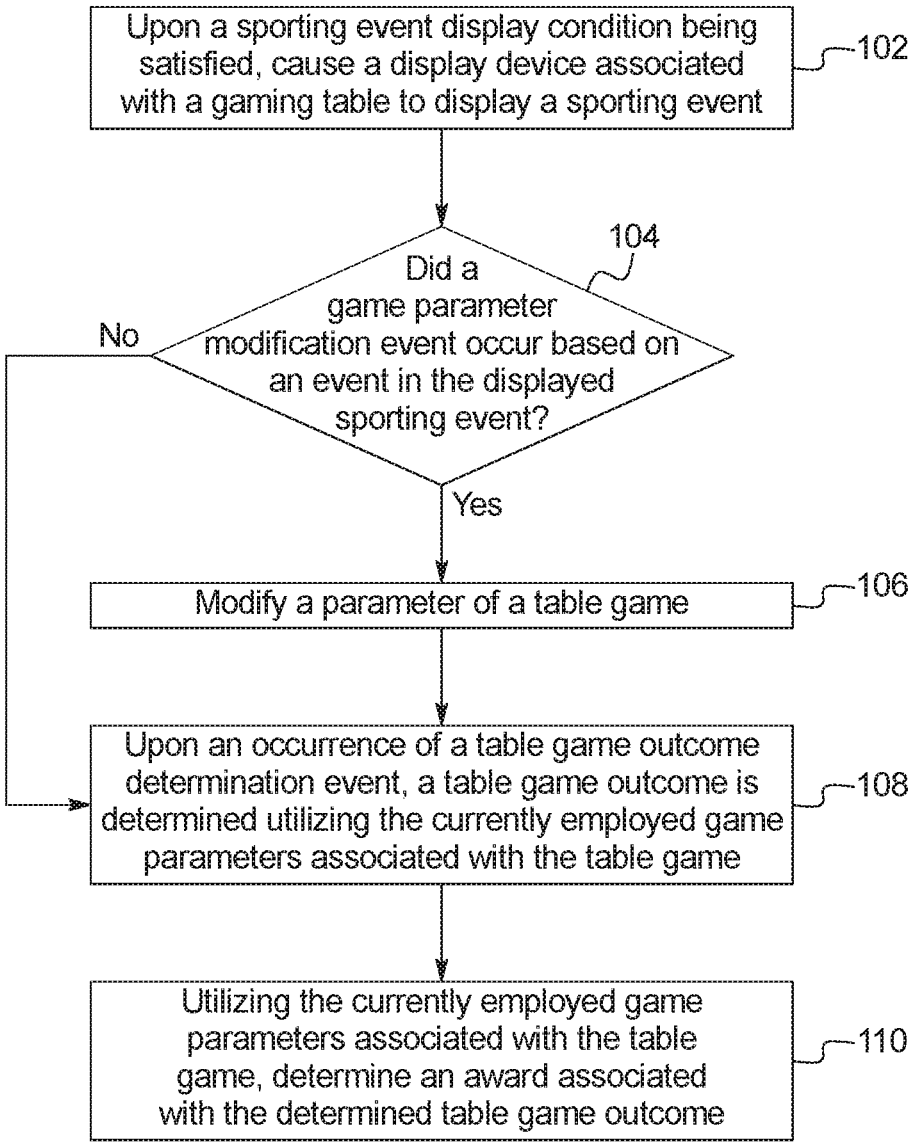
FIG. 1 is a flowchart of one embodiment of the gaming table component disclosed herein modifying a parameter of a play of a table game based on an occurrence of an event in a sporting event.

Modifying Parameters of a Play of a Table Game Based on Sporting Events

In various embodiments, the present disclosure relates generally to systems and methods which utilize the results of a sporting event to modify one or more parameters of a play of a table game.

In certain embodiments, the system disclosed herein displays a video stream of a sporting event and additionally enables a player to play one or more games at a gaming table in association with the sporting event. In these embodiments, zero, one or more parameters of the plays of the games at the gaming table are based on or otherwise influenced by one or more events occurring within the sporting event. That is, in determining one or more parameters of a play of a game (e.g., determining an aspect of a paytable utilized for the play of the game at the gaming table and/or determining one or more features to activate (or enhance) for the play of the game at the gaming table), the gaming system utilizes one or more events occurring (or not occurring) in association with one or more sporting events. Put differently, the system disclosed herein modifies one or more states of a table game based on a current state of a sporting event thereby introducing an additional avenue for a bystander to interact with a sporting event and potentially win additional awards in the process. Additionally, by integrating sporting events with table games into the betting opportunities disclosed herein (which presents various challenges due to the unpredictability of both live sporting events and table games as well as the timing of such events), the system provides an engaging experience for players by converting a passive activity (i.e., watching a sporting event) into an active activity (i.e., playing a game at the gaming table wherein one or more events occurring (or not occurring) during the sporting event factor into how the game at the gaming table proceeds).

While certain embodiments described below are directed to a primary game, such as a wagering game, played at a gaming table, it should be appreciated that such embodiments may additionally or alternatively be employed in association with a secondary game, such as a bonus game played at a gaming table, a communal game played at one or more gaming tables, and/or a tournament game played at one or more gaming tables. In certain embodiments, the secondary game occurs based on a displayed event associated with a play of a primary game. In certain embodiments, the secondary game occurs based on a displayed event occurring in the sporting event. In certain embodiments, the secondary game occurs based on an event independent of any displayed event associated with the play of the primary game and independent of any displayed event occurring in the sporting event.

It should be further appreciated that in different embodiments, the gaming table component utilized to modify one or more parameters of a play of a table game is part of or otherwise associated with any suitable intelligent gaming table which facilitates the play of a table game and/or any suitable component associated with a non-intelligent gaming table which facilitates the play of a table game. In one such embodiment, the gaming table component is part of or otherwise associated with an intelligent gaming table which enables one or more players to play one or more suitable games by placing one or more wagers utilizing gaming chips. In this embodiment, the gaming table component includes zero, one or more input devices and zero, one or more display devices (e.g., to display a sporting event). In another such embodiment, the gaming table is a non-intelligent gaming table including a suitable support structure, such as one or more legs, a playing surface and a dealer position. In this embodiment, the gaming table component is separate from but associated with the gaming table and includes zero, one or more input devices and zero, one or more display devices (e.g., to display a sporting event).

In certain embodiments, the gaming table component utilized to modify one or more parameters of a play of a table game additionally includes or is otherwise associated with a communication interface (e.g., to communicate data regarding the play of the game at the gaming table to an electronic gaming machine and/or to receive data from a sporting event data service to obtain information regarding one or more sporting events that may influence how the game played at the gaming table proceeds). In certain of these embodiments, the system disclosed herein utilizes zero, one or more video camera which capture the live action of the gaming table and zero, one or more video processing servers which process and stream the captured video to any suitable electronic gaming machine ("EGM") which displays one or more table games being played at a gaming table (such as a terminal associated with an electronic table game, a slot machine, a video poker machine, a video lottery terminal, a video keno machine, a video bingo machine located on a casino floor, or a sports betting terminal), and/or any suitable personal gaming device (wherein the data associated with the one or more games being played at a gaming table and the sporting event are accessed over a network).

FIG. 1 is a flowchart of an example process or method of operating the gaming table component of the present disclosure. In various embodiments, the process is represented by a set of instructions stored in one or more memories and executed by one or more processors. Although the process is described with reference to the flowchart shown in FIG. 1, many other processes of performing the acts associated with this illustrated process may be employed. For example, the order of certain of the illustrated blocks or diamonds may be changed, certain of the illustrated blocks or diamonds may be optional, or certain of the illustrated blocks or diamonds may not be employed.

Figure 2:
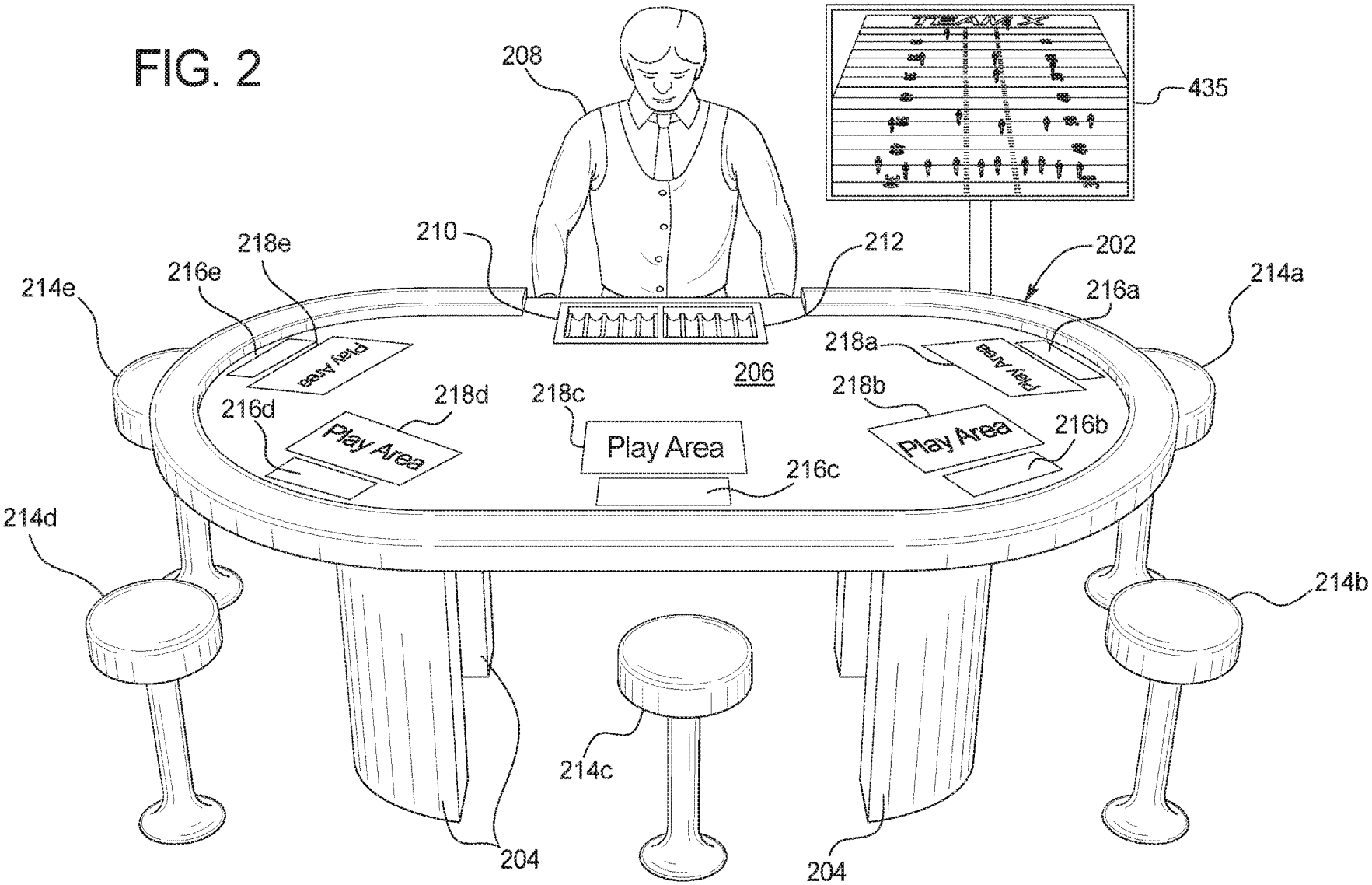
FIG. 2 is a perspective view of one embodiment of a gaming table of the present disclosure.

In different embodiments, upon a sporting event display condition being satisfied, the gaming table component causes a display device associated with the gaming table to display a sporting event as indicated by block 102 of FIG. 1. For example, as seen in FIG. 2, the gaming table component (not shown) causes a display device 435 associated with the gaming table 202 to display a stream of a live sporting event (e.g., a live football game) during one or more plays of one or more table games occurring at the gaming table.

In certain embodiments, a gaming table is associated with a single sporting event wherein one or more parameters of a play of a table game may be modified for each of the player stations or seats of that gaming table based on one or more events occurring (or not occurring) in that sporting event. In certain other embodiments, a gaming table is associated with a plurality of sporting events wherein one or more parameters of a play of a table game may be modified for each of the player stations or seats of that gaming table based on one or more events occurring (or not occurring) in one or more of the plurality of sporting events associated with the gaming table.

In certain embodiments, each of the player stations or seats of a gaming table is associated with a single individual sporting event, wherein different player stations or seats of the gaming table may be associated with the same or different individual sporting events. In these embodiments, for each player station or seat of the gaming table, one or more parameters of a play of a table game may be modified for that individual player station or seat of that gaming table based on one or more events occurring (or not occurring) in the individual sporting event associated with that player station or seat. In certain embodiments, each of the player stations or seats of a gaming table is associated with an individual plurality of sporting events, wherein different player stations or seats of the gaming table may be associated with the same or different individual pluralities of sporting events. In these embodiments, for each player station or seat of the gaming table, one or more parameters of a play of a table game may be modified for that individual player station or seat of that gaming table based on one or more events occurring (or not occurring) in one or more of the individual plurality of sporting events associated with that player station or seat. It should be appreciated that in these embodiments, the sporting event(s) associated with the individual player stations or seats of the gaming table may be the same sporting event(s) or different sporting event(s) than the sporting event displayed by the display device associated with the gaming table.

In certain embodiments, each player participating in the play of the table game being played at the gaming table that is identified by the gaming table component, such as in association with that player logging into a player tracking system using a player tracking card and/or mobile device application associated with the player tracking system, is associated with a single individual sporting event, wherein different identified players may be associated with the same or different individual sporting events. In these embodiments, for each identified player, one or more parameters of a play of a table game may be modified for that individual player based on one or more events occurring (or not occurring) in the individual sporting event associated with that player. In certain embodiments, each player participating in the play of the table game being played at the gaming table that is identified by the gaming table component is associated with an individual plurality of sporting events, wherein different identified players may be associated with the same or different individual pluralities of sporting events. In these embodiments, for each player, one or more parameters of a play of a table game may be modified for that individual player based on one or more events occurring (or not occurring) in one or more of the individual plurality of sporting events associated with that player. It should be appreciated that in these embodiments, the sporting event(s) associated with the individual players may be the same sporting event(s) or different sporting event(s) than the sporting event displayed by the display device associated with the gaming table.

It should be appreciated that while the displayed sporting event is illustrated herein as a play of a football game being associated with an entire gaming table, the gaming table component disclosed herein may cause a display device to display (in association with an entire gaming table, in association with one or more individual player stations or seats of the gaming table and/or in association with one or more individual players participating in the play of the table game being played at the gaming table) any suitable live, historic, recreated, and/or simulated sporting event of any suitable sport at any professional and/or amateur level including, but not limited to, football, basketball, baseball, boxing, horse racing, wrestling, mixed martial arts, golf, cricket, soccer, hockey, field hockey, tennis, volleyball, table tennis, rugby, swimming, diving, archery, cycling, billiards, fishing, gymnastics, hunting, track and field, sailing, and/or car racing. It should be further appreciated that the sporting event that the gaming table component utilizes to modify one or more parameters of one or more plays of a game may be selected by a player, selected by an operator, such as a gaming establishment operator, or selected based on scheduling (i.e., which sporting events are currently being played live), popularity (e.g., sporting events including sports teams from my populous cities are selected over sporting events including sports teams from less populous cities) and/or location (e.g., a sporting event played at a first location relatively closer to a gaming establishment is selected over a sporting event played at a second location relatively further away from the gaming establishment. It should be additionally appreciated that in certain embodiments, the player and/or operator, such as a dealer at the gaming table, has the option to disable the utilization of data associated with one or more sporting events potentially modifying one or more parameters of one of more plays of a game.

In one embodiment, the gaming table component causes at least one display device of the gaming table to display one or more sporting events during one or more plays of one or more table games being played at the gaming table. In another embodiment, the gaming table component additionally or alternatively causes one or more community or overhead display devices to display part or all of one or more sporting events during one or more plays of one or more table games being played at the gaming table to one or more other players or bystanders either at a gaming establishment or viewing over a network, such as the internet. In another embodiment, the gaming table component additionally or alternatively causes one or more internet sites or mobile device applications to each display one or more sporting events during one or more plays of one or more table games being played at the gaming table. In another embodiment, the gaming table component additionally or alternatively causes one or more personal gaming devices, such as a mobile device, to display part or all of one or more sporting events during one or more plays of one or more table games being played at the gaming table such that one or more sporting events are viewed from the personal gaming device, such as from a mobile device, and one or more other sporting events are viewed from another device. In another embodiment, the gaming table component does not display nor control the displaying of the sporting event on any display device.

In certain embodiments, the sporting event display condition is satisfied and the gaming table component causes a display device associated with the gaming table to display the sporting event upon a placement of a wager on a table game. In certain embodiments, the sporting event display condition is satisfied and the gaming table component causes a display device associated with the gaming table to display the sporting event upon receipt of an input to display the sporting event. In certain embodiments, the sporting event display condition is satisfied and the gaming table component causes a display device associated with the gaming table to display the sporting event upon a determination by the gaming table component to display the sporting event to attract users to the gaming table component. In certain embodiments, the sporting event display condition is satisfied and the gaming table component causes a display device associated with the gaming table to display the sporting event upon a placement of a sporting event wager. In these embodiments, the sporting event wager available to be placed include any suitable sporting event wager including, but not limited to, any suitable moneyline wager on an outcome of a sporting event (e.g., Team X will win the game), any suitable wager on an outcome of a sporting event which accounts for a point spread (e.g., Team X will win the game by ten points), any suitable proposition wager on an in-game event occurring or not occurring within the sporting event (e.g., Player A will make the next free throw), any suitable handicap wager, any suitable if and reverse wager, any suitable total/over-under wager, any suitable full cover wager, any suitable future/outright wager, any suitable parlay/accumulator multiple sporting event wagers (including but not limited to a progressive parlay wager, a teaser and pleaser wager, a grand salami wager, and/or a round robin wager), any suitable cross-table sporting event wager between different gaming tables associated with different sporting events and/or sports teams, and/or any combination of these different available sporting event wagers.

In certain embodiments, the sporting event displayed includes a live sporting event, such as sporting event currently being played. In certain embodiments, the sporting event displayed includes a historical sporting event, such as a prerecorded sporting event, a recreation of a prior sporting event, and/or a simulated sporting event (e.g., a sporting event created from different parts of different historical sporting events wherein zero, one or more results of such a simulated sporting event are randomly determined). In these embodiments, prior to and/or after each play or round of a game at a gaming table (or a series of plays or rounds of a game at a gaming table), the system displays a play or portion of the historical sporting event, the recreation of a prior sporting event and/or the simulated sporting event. For example, the system displays a portion of a historical sporting event after a hand of a table game wherein the system offers the winner of that hand a bonus award (e.g., money, player tracking points, virtual points, sports team related merchandise) if the displayed portion of the historical sporting event results in a designated event such as a score. In another example, the system displays a portion of a historical sporting event before the hand of the table game, wherein the system offers the winner of the hand a bonus if the winning hand is associated with the displayed portion of the historical sporting event, such as the system offering a bonus award to winning hands with a playing card having a rank of three in them if the displayed portion of the historical sporting event is an advancement of 3 yards. In another embodiment, the display of the historical sporting event, the recreation of a prior sporting event and/or the simulated sporting event starts with each round of the table game and pauses at the end of the play of each round of the table game such that the display of the historical sporting event, the recreation of a prior sporting event and/or the simulated sporting event occurs simultaneously with the play of the table game. It should be appreciated that to prevent players from determining an outcome of the historic sporting event prior to the play of the game, the gaming table component masks or otherwise anonymizes certain of the identifying information associated with that sporting event, such as anonymizes identifying information about teams, historical team records, sporting event players, and/or historical sporting event player statistics.

In certain embodiments, the displayed sporting event includes a virtual or electronic sport ("eSport") event played by humans, by computer driven participants or by a mix of human and computer driven participants. As such, it should be appreciated that while described herein as a player playing one or more table games wherein zero, one or more parameters of such plays are at least influenced by one or more events occurring (or not occurring) during a live sporting event, the gaming table component is operable to influence zero, one or more parameters of one or more plays of one or more table game by one or more events occurring (or not occurring) during a non-live sporting event, such as a prerecorded sporting event or a recreation of a historical sporting event and/or an eSport event. It should be further appreciated that the displayed sporting event can be a live broadcast of the sporting event or an animated or textual representation of the sporting event, and the sporting event may be displayed in its entirety or portions of the sporting event may be displayed periodically, such as in the form of replays or highlight reels. For example, after a significant play of a sporting event, such as a scoring play or a play associated with a sporting event wager, the gaming table component causes a display device associated with the gaming table to display a portion of the sporting event containing the significant play.

In addition to displaying a sporting event, the gaming table component determines if a game parameter modification event has occurred based on an event in the displayed sporting event as indicated in diamond 104 of FIG. 1. That is, in determining whether or not to modify a parameter of a table game, the gaming table component determines whether or not an event occurred in a sporting event associated with that table game. In different embodiments, the gaming table component communicates with one or more sporting event servers, such as a server associated with a sporting event data service, to receive data associated with the sporting event to determine whether or not an event occurring in the sporting event associated with that table game.

Figure 3A:
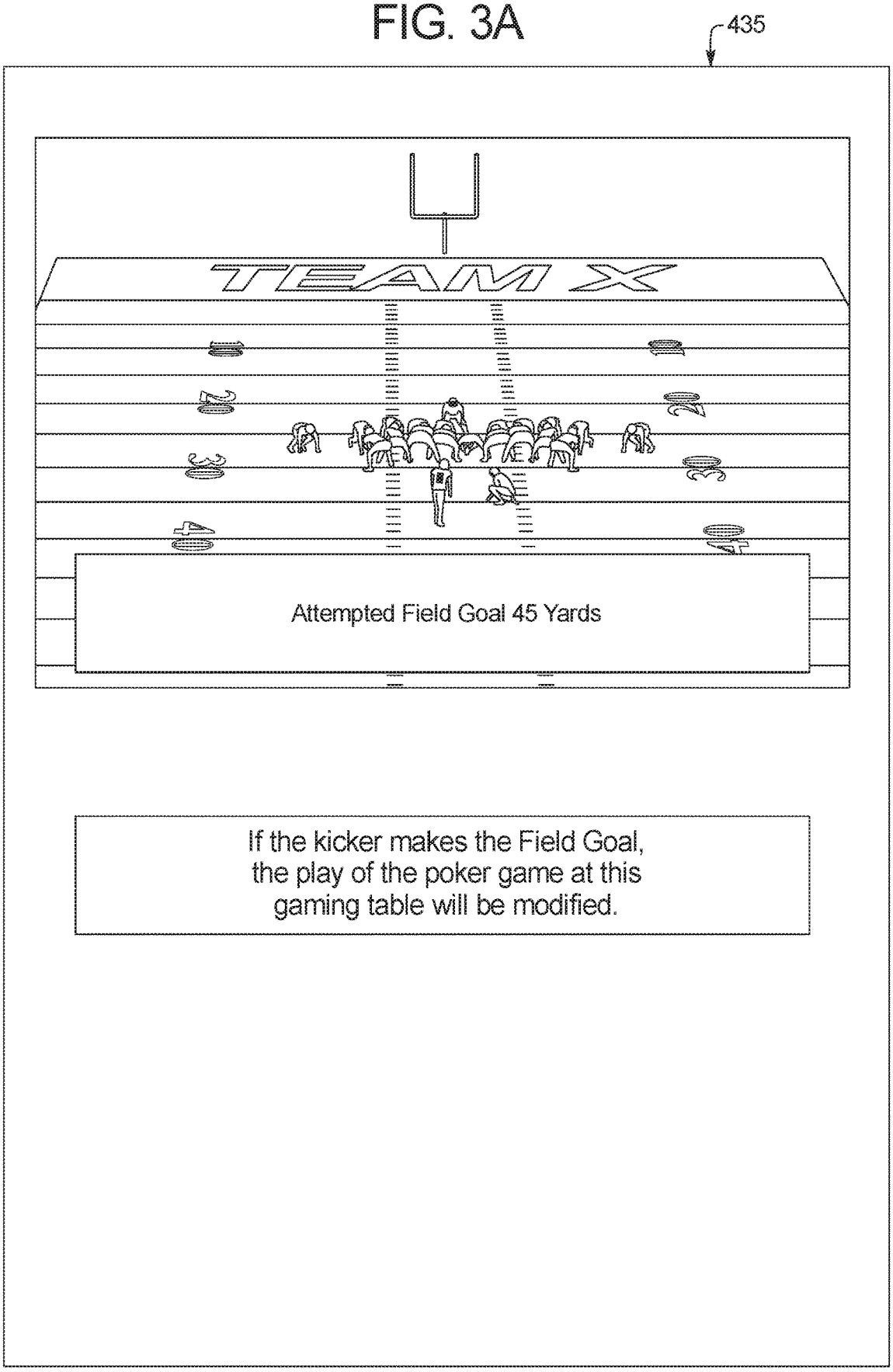
FIGS. 3A, and 3B are front views of one embodiment of a display device associated with a gaming table component of a gaming table, wherein a parameter of a play of a table game is modified based on an event occurring in a sporting event.

In certain embodiments, a game parameter modification event occurs in association with an action or event occurring in a sporting event. In these embodiments, the occurrence of the action or event (or the lack of the occurrence of the action or event) determine if the game parameter modification event has occurred. That is, the gaming table component utilizes one or more aspects of a sporting event to potentially modify one or more parameters of a table game. For example, as seen in FIG. 3A, if a poker game played at a gaming table (not shown) is associated with a live football game being displayed, the action of the sporting event associated with the game parameter modification event is the scoring of points and a 45 yard field goal is being attempted in the live football game being displayed by a kicker, the gaming table component determines if the game parameter modification event occurs based on the results of the attempted field goal.

In certain embodiments, a game parameter modification event occurs in association with a series of actions or events occurring in a sporting event. In these embodiments, the occurrence of this series of actions or events (or the lack of the occurrence of these actions or events) determine if the game parameter modification event has occurred such that the gaming table component utilizes multiple aspects of a sporting event to potentially modify one or more parameters of a table game. For example, if a blackjack game being played at a gaming table is associated with a baseball game and the series of events includes the throwing of six strikes in a row, the gaming table component determines if the game parameter modification event occurs based on whether or not six strikes are thrown in a row (regardless of which baseball player on which baseball team or which combination of baseball players on which baseball team(s) contributed to throwing six strikes in a row).

In certain embodiments, a game parameter modification event occurs in association with a series of actions or events occurring over a plurality of sporting events. In these embodiments, the occurrence of this series of actions or events (or the lack of the occurrence of these actions or events) determine if the game parameter modification event has occurred such that the gaming table component utilizes multiple aspects of multiple sporting events to potentially modify one or more parameters of a table game. For example, if a Baccarat game being played at a gaming table is associated with each of the collegiate hockey games being played on a particular day and the series of events includes at least twenty goals being scored across each of the four games being played on that particular day, the gaming table component determines if the game parameter modification event occurs based on whether or not at least twenty goals were scored (regardless of which hockey players on which hockey team or which combination of hockey players on which hockey team(s) contributed to scoring the designated quantity of goals).

In certain embodiments, a game parameter modification event occurs in association with an action or event occurring in a sporting event by one or more specific sports teams. In these embodiments, the occurrence of the action or event (or the lack of the occurrence of the action or event) in association with one or more particular sports teams (and not in association with any other sports teams) determine if the game parameter modification event has occurred. That is, the gaming table component utilizes one or more sports team specific aspects of a sporting event to potentially modify one or more parameters of a table game. For example, if a three-card poker game being played at a gaming table is associated with a first team of a live football game, the action of the sporting event associated with the game parameter modification event is the first team obtaining a first down by running the football, the gaming table component determines if the game parameter modification event occurs based on whether or not the first team runs the football for a first down.

In certain embodiments, a game parameter modification event occurs in association with a series of actions or events occurring by one or more specific sports teams in a sporting event. In these embodiments, the occurrence of this series of actions or events (or the lack of the occurrence of these actions or events) in association with one or more particular sports teams (and not in association with any other sports teams) determine if the game parameter modification event has occurred such that the gaming table component utilizes multiple sports team aspects of the displayed sporting event to potentially modify one or more parameters of a table game. For example, if a craps game being played at a gaming table is associated with a particular baseball team of a baseball game and the series of events includes that baseball team obtaining seven hits in a row, the gaming table component determines if the game parameter modification event occurs based on whether or not that particular baseball team obtained seven hits in a row.

In certain embodiments, a game parameter modification event occurs in association with a series of actions or events occurring by one or more specific sports teams over a plurality of sporting events. In these embodiments, the occurrence of this series of actions or events (or the lack of the occurrence of these actions or events) in association with one or more particular sports teams over multiple sporting events (and not in association with any other sports teams over multiple sporting events) determine if the game parameter modification event has occurred such that the gaming table component utilizes multiple sports team aspects of multiple sporting events to potentially modify one or more parameters of a table game. For example, if a pai gow poker game being played at a gaming table is associated with each of the home soccer teams for the soccer games being played on a particular day and the series of events includes at least twelve goals being scored by the four home teams across each of the games being played on that particular day, the gaming table component determines if the game parameter modification event occurs based on whether or not twelve goals were scored by the four home soccer teams.

In certain embodiments, a game parameter modification event occurs in association with an action or event occurring by one or more particular sporting event participants in a sporting event. In these embodiments, the occurrence of the action or event (or the lack of the occurrence of the action or event) in association with such particular sporting event participants (and not by any other sporting event participants) determine if the game parameter modification event has occurred. That is, the gaming table component utilizes one or more sporting event participant specific aspects of a sporting event to potentially modify one or more parameters of a table game. For example, if a sic bo game being played at a gaming table is associated with an individual football player of a live football game, the gaming table component determines if the game parameter modification event occurs based on whether or not that individual football player advanced the ball more than six yards during a single play.

In certain embodiments, a game parameter modification event occurs in association with a series of actions or events occurring by one or more particular sporting event participants in a sporting event. In these embodiments, the occurrence of this series of actions or events (or the lack of the occurrence of these actions or events) in association with such particular sporting event participants (and not by any other sporting event participants) determine if the game parameter modification event has occurred such that the gaming table component utilizes multiple sporting event participant specific aspects of a sporting event to potentially modify one or more parameters of a table game. For example, if a poker game being played at a gaming table is associated with a particular pitcher of a baseball game and the series of events includes that particular pitcher throwing of six balls in a row, the gaming table component determines if the game parameter modification event occurs based on whether or not that particular pitcher threw six balls in a row.

In certain embodiments, a game parameter modification event occurs in association with a series of actions or events by one or more particular sporting event participants occurring over a plurality of sporting events. In these embodiments, the occurrence of this series of actions or events (or the lack of the occurrence of these actions or events) in association with such particular sporting event participants (and not by any other sporting event participants) determine if the game parameter modification event has occurred such that the gaming table component utilizes multiple sporting event participant aspects of multiple sporting events to potentially modify one or more parameters of a table game. For example, if a casino war game being played at a gaming table is associated with each of point guards on the roster of a basketball team and the series of events includes fifteen blocks made by those point guards over the course of three basketball games played, the gaming table component determines if the game parameter modification event occurs based on whether or not the collection of the point guards on the roster of the basketball team made at least fifteen blocks over the course of three basketball games played.

In certain embodiments, a game parameter modification event occurs in association with the group of players playing the game at the gaming table. In these embodiments, different gaming tables are associated with different sporting events, sports teams and/or sporting event participants wherein one or more events occurring (or not occurring) in association with the sporting event, sports team and/or sporting event participant associated with the group of players cause a modification of one or more aspects of the table game being played by the group of players (but not by other players playing the game at the gaming table not part of the group of players).

In certain embodiments, a game parameter modification event individually occurs in association with each of the players playing the game at the gaming table. In these embodiments, the gaming tables are not associated with different sporting events, sports teams and/or sporting event participants but the individual players participating in the game at the gaming table are associated with different sporting events, sports teams and/or sporting event participants, wherein one or more events occurring (or not occurring) in association with the sporting event, sports team and/or sporting event participant associated with the individual player cause a modification of one or more aspects of the table game being played by the individual player (but not by other players playing the game at the gaming table).

It should be appreciated that any suitable configuration of associating sporting events, sports teams and/or sporting event participants with one or more game parameter modification events may be employed in association with the present disclosure. It should be further appreciated that any suitable action (or inaction), any suitable sporting event statistic, any suitable sports team statistic, any suitable sporting event participant statistic or any suitable combination of one or more actions (or inactions), sporting event statistics, sports team statistics, and/or sporting event participant statistics may be employed in determining whether one or more game parameter modification events occur as disclosed herein.

In certain embodiments, the occurrence of a modification of a game parameter based on an occurrence of a game parameter modification event is conditional on one or more players at the gaming table having placed a sporting event wager on the sporting event. In these embodiments, the player places a sporting event wager at the gaming table and/or presents evidence of a placed sporting event wager, such as a paper or virtual sporting event wager ticket, to satisfy the condition. In certain embodiments, the placement of the sporting event wager qualifies as an occurrence of the game parameter modification event. In certain embodiments, the placement of a wager on the table game being played at the gaming table qualifies as an occurrence of the game parameter modification event. In certain embodiments, the occurrence of the game parameter modification event is independent of the player having placed a sporting event wager on the sporting event.

In certain embodiments, the occurrence of the game parameter modification event is conditional on one or more parameters of the sporting event. For example, prior to determining that a game parameter modification event occurs in association with a player's favorite baseball team (as indicated by the player or determined in association with a player tracking system which maintains a player tracking account associated with the player), that baseball team must first be batting in the sporting event. In certain embodiments, the occurrence of the game parameter modification event is independent of any parameters of the sporting event.

In certain embodiments, a table game is associated with a particular sports team and/or sporting event participant, wherein the game parameter modification event occurs in association with that particular sports team and/or sporting event participant (and not any sports team or any sporting event participant). In these embodiments, the gaming table component causes a game parameter modification to occur for that table game in association with the particular sports team and/or sporting event participant based on a particular action (or inaction) by that sports team and/or sporting event participant in the sporting event. For example, if a poker game played at a gaming table is associated with a particular basketball player scoring points in a game, then the game parameter modification event occurs each time that basketball player scores one or more points (but does not occur when any teammate of that particular basketball player scores any points).

Figure 3B:
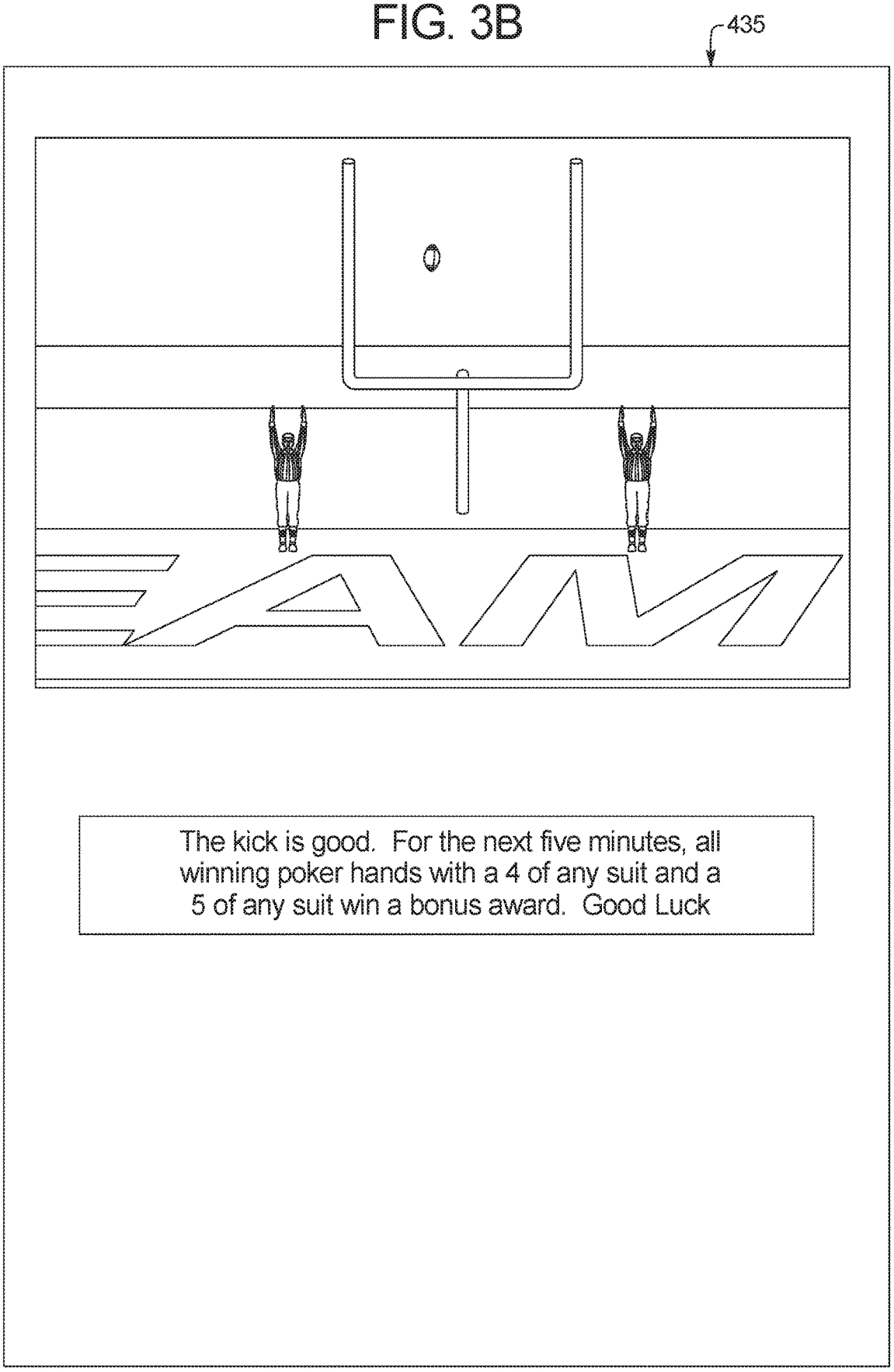

Returning to FIG. 1, if the gaming table component determines that a game parameter modification event occurred based on an event in the displayed sporting event, the gaming table component modifies (or instructs the dealer at the gaming table to modify) a parameter of a table game as indicated in block 106. In these embodiments, the occurrence of an event (or the lack of the occurrence of the event) in the sporting event causes the gaming table component to modify one or more parameters of a table game. For example, as seen in FIG. 3B, upon determining that the attempted 45 yard field goal in the live football game was good (i.e., the game parameter modification event occurred), the gaming table component modifies (or instructs the dealer at the gaming table to modify) the play of the poker game such that for the next five minutes, all winning poker hands with a 4 of any suit and a 5 of any suit win a bonus award. As illustrated by this example, certain modifications of certain parameters of a game occur based on one or more past occurrences of one or more game parameter modification events.

In various embodiments, upon an occurrence of a game parameter modification event, the gaming table component modifies (or instructs the dealer at the gaming table to modify) one or more aspects of a paytable employed in association with the table game. In these embodiments, responsive to one or more events occurring (or not occurring) in one or more sporting events, the gaming table component modifies (or instructs the dealer at the gaming table to modify) one or more game components associated with the game by modifying a paytable associated with the table game. For example, as a result of a change in a quarter of play of a football game (and/or any suitable action or event in the play of the football game such as, but not limited to, a fumble, a yellow card, a red card, a score of any type, an attempt to score, a blocked score, a change of possession, an advancement, a penalty, or a timeout), the gaming table component determines that a game parameter modification event occurs and modifies one or more aspects of the paytable. Such a configuration provides that the system disclosed herein employs a dynamic paytable wherein one or more events occurring (or not occurring) in one or more sporting events determine one or more aspects of such a dynamic paytable.

In certain embodiments, upon an occurrence of a game parameter modification event, the gaming table component modifies (or instructs the dealer at the gaming table to modify), one or more awards associated with one or more game outcomes, such as increasing one or more awards. For example, upon determining that the football of an associated professional football game is in the red zone on a fourth down (i.e., the occurrence of a game parameter modification event based on a current state of the sporting event), the gaming table component increases the award associated with a full house outcome by one-thousand credits. In this example, the gaming table component maintains the increase of the award associated with the full house outcome until the football is no longer in the red zone on a fourth down (or after one or more plays of the game). In another example, upon determining that seven goals have been scored in a college hockey game (i.e., the occurrence of a game parameter modification event based on a score of the sporting event), the gaming table component determines that the awards associated with all winning poker hands including at least two playing cards with a rank of seven are modified by a multiplier of 7×. In this example, the gaming table component maintains the application of the modifier to all poker hands including at least two playing cards with a rank of seven until another goal is scored in the hockey game (or after seven additional plays of the game have been completed).

In certain embodiments, upon an occurrence of a game parameter modification event, the gaming table component modifies (or instructs the dealer at the gaming table to modify) the paytable associated with the game by modifying one or more probabilities associated with one or more game outcomes. For example, for the bottom of the fifth inning of a professional baseball game (i.e., the occurrence of a game parameter modification event), the gaming table component increases the probability of obtaining a winning poker hand by designating all playing cards with a rank of five as wild cards.

In various embodiments, upon an occurrence of a game parameter modification event, the gaming table component activates different components of the paytable, such as which paytable categories are associated with which awards, if any. In these embodiments, responsive to one or more events occurring (or not occurring) in one or more sporting events, the gaming table component modifies (or instructs the dealer at the gaming table to modify) one or more game components associated with the paytable by activating such game components. For example, when a first home run is hit in a baseball game (i.e., the occurrence of a game parameter modification event), the gaming table component enhances a royal flush outcome by associating the royal flush outcome with a progressive award (wherein prior to the first home run being hit, the royal flush was not associated with the progressive award).

In certain embodiments, the gaming table component enables (or instructs the dealer at the gaming table to enable) different progressive awards to be available to be won based on one or more events occurring (or not occurring) in one or more sporting events. For example, if a football team associated with a player (as determined via the player's historic sporting event wagering activities and/or via the player's account) has possession of the football, the gaming table component enables (or instructs the dealer at the gaming table to enable) a first level progressive award to be available to be won by the player in association with the table game being played. In this example, if the football team associated with the player is in the lead during the football game (or alternatively the score is tied), the gaming table component enables (or instructs the dealer at the gaming table to enable) a second, higher level progressive award to be available to be won by the player in association with the table game being played. In this example, if the football team associated with the player has possession of the football and is in the lead during the football game (or alternatively the score is tied), the gaming table component enables (or instructs the dealer at the gaming table to enable) a third, higher level progressive award to be available to be won by the player in association with the table game being played.

In certain embodiments, upon an occurrence of a game parameter modification event, the gaming table component enables one or more progressive awards to be available to be won. For example, the system maintains two progressive awards, such as a major progressive award and a minor progressive award, that are associated with two gaming tables that are each associated with a different sports team. In this example, when one sports team has the ball during a football game, players at the gaming table associated with that sports team are eligible to win the major progressive award while players at a second gaming table associated with another sports team are eligible to win the minor progressive award. It should be appreciated that in this example, the evaluation of which progressive award is currently eligible for each gaming table would happen at the beginning of the play of the game, such as at the beginning of a poker hand, to prevent a player from stalling and hoping to get a change in possession before making a decision. In another example wherein the system maintains multiple progressive awards associated with multiple gaming tables and multiple sports teams, a portion of one or more wagers placed at the gaming table associated with the sports team having possession of the ball contribute to one or more of the progressive awards. In another example, the system maintains a progressive award associated with two gaming tables that are each associated with a different sports team. In this example, when one team has the ball during a football game, players at a first gaming table associated with that sports team are eligible to win that progressive award while players at a second gaming table associated with another sports team are not eligible to win that progressive award. In another example wherein the system maintains a progressive award associated with two gaming tables that are each associated with a different sports team, players at the gaming table associated with the last sports team to score are eligible to win the progressive award.

In certain embodiments, upon an occurrence of a game parameter modification event, the gaming table component modifies (or instructs the dealer at the gaming table to modify) one or more components of the paytable. In one such embodiment, each time a game parameter modification event occurs based on an event occurring (or not occurring) in a sporting event, the gaming table component modifies (or instructs the dealer at the gaming table to modify) which awards are associated with which game outcomes of the paytable. For example, when a first home run is hit in a baseball game (i.e., the occurrence of a game parameter modification event), the gaming table component associates a royal flush with a first level progressive award of a multi-level progressive award configuration, and when a second home run is hit in the baseball game, the gaming table component associates the royal flush with a second level progressive award of the multi-level progressive award configuration.

In certain embodiments, each time a game parameter modification event occurs based on an event occurring (or not occurring) in a sporting event, the gaming table component activates or deactivates the same component of the paytable. In these embodiments, the activation/deactivation of one or more components of the paytable are toggled on and off by the occurrences of events of a sporting event. For example, the first time a game parameter modification event occurs based on a first three point shot being scored by the visiting team in a basketball game, the gaming table component activates a jacks or better poker paytable category from being a losing poker hand to a winning poker hand. In this example, the second time the game parameter modification event occurs based on a second three point shot being scored by the visiting team in the basketball game, the gaming table component deactivates the jacks or better poker paytable category (i.e., converts that poker hand from a winning poker hand back into a losing poker hand).

In certain embodiments, each time a game parameter modification event occurs based on an event occurring (or not occurring) in a sporting event, the gaming table component activates (or alternatively enhances) a different component of a paytable. For example, the first time a game parameter modification event occurs based on a first block being recorded by a starting guard in a basketball game, the gaming table component increases the payout associated with the lowest ranked winning category of a paytable. In this example, the second time the game parameter modification event occurs based on a second block being recorded by a starting guard in the basketball game, the gaming table component increases the payout associated with the second lowest ranked winning category of the paytable.

In certain embodiments, rather than modifying one or more awards associated with one or more game outcomes, the gaming table component selects one of a plurality of paytables to utilize upon an occurrence of a game parameter modification event. In these embodiments, the gaming table component maintains a plurality of different paytables wherein which paytable is selected to be employed in one or more plays of the game is based on one or more events occurring (or not occurring) in one or more sporting events. For example, when the difference in the score between two teams of a football game is between zero and seven points, the gaming table component employs a first paytable, when the difference in the score between the two teams of the football game is between eight and fourteen points, the gaming table component employs a second paytable, and when the difference in the score between the two teams of the football game is greater than fifteen points, the gaming table component employs a third paytable.

In certain embodiments, the average expected payouts of each of the paytables are the same such that regardless of which paytable is selected based on the events of the sporting event, a play of a game has the same average expected payout. In certain embodiments, the average expected payouts of two or more of the paytables are different such the events of the sporting event determine the average expected payout of a play of a game. For example, when the difference in total offensive yards between two teams of a football game is between zero and one-hundred yards, the gaming table component employs a first paytable, when the difference in total offensive yards between the two teams of the football game is between one-hundred-one and two-hundred-fifty yards, the gaming table component employs a second, more lucrative paytable, and when the difference in total offensive yards between the two teams of the football game is greater than two-hundred-fifty yards, the gaming table component employs a third, less lucrative paytable.

In certain embodiments, upon an occurrence of a game parameter modification event, the gaming table component modifies (or instructs the dealer at the gaming table to modify) the paytable associated with the game by activating one or more supplemental awards associated with the paytable employed for the game. In different embodiments, the supplemental awards available to be won based on one or more events occurring (or not occurring) in one or more sporting events (and/or one or more awards provided in association with a triggered play of a game as described herein) includes, but is not limited to, one or more of: a sporting event wager placed on a sports team associated with a gaming table, a quantity of monetary credits, a quantity of non-monetary credits, a quantity of promotional credits, a quantity of player tracking points, a progressive award, a modifier, such as a multiplier, a quantity of free plays of one or more games, a quantity of plays of one or more secondary or bonus games, a multiplier of a quantity of free plays of a game, one or more lottery based awards, such as lottery or drawing tickets, a wager match for one or more plays of one or more games, an increase in the average expected payback percentage for one or more plays of one or more games, one or more comps, such as a free dinner, a free night's stay at a hotel, a high value product such as a free car, or a low value product, one or more bonus credits usable for online play, a lump sum of player tracking points or credits, a multiplier for player tracking points or credits, an increase in a membership or player tracking level, one or more coupons or promotions usable within and/or outside of the gaming establishment (e.g., a 20% off coupon for use at a convenience store), virtual goods, an access code usable to unlock content on an internet.

In various embodiments, upon an occurrence of a game parameter modification event, the gaming table component modifies one or more features associated with the table game. In these embodiments, responsive to one or more events occurring (or not occurring) in one or more sporting events, the gaming table component modifies (or instructs the dealer at the gaming table to modify) one or more game components associated with the game. For example, whenever a bowler throws three strikes in a row (i.e., the occurrence of a game parameter modification event), the gaming table component modifies (or instructs the dealer at the gaming table to modify) the deck of cards, such as by reshuffling the deck, utilizing a new deck, or utilizing a different deck that has different cards, such as a deck that includes one or more wild cards. In another example, when a specific horse wins a horse race (i.e., the occurrence of a game parameter modification event), the gaming table component modifies (or instructs the dealer at the gaming table to modify) the table surface to enable certain wagers and/or change certain available wagers, such as enabling or disabling wagering on certain areas of a craps table based on the outcome of the horse race.

In various embodiments, upon an occurrence of a game parameter modification event, the gaming table component activates one or more features associated with the table game. In these embodiments, responsive to one or more events occurring (or not occurring) in one or more sporting events, the gaming table component modifies (or instructs the dealer at the gaming table to modify) one or more game components associated with the game by activating one or more features associated with the game. For example, whenever the home team scores a touchdown in a football game (i.e., the occurrence of a game parameter modification event), the gaming table component activates a bad beat feature wherein one or more awards are available responsive to a consecutive number of losing hands (or a consecutive number of winning hands associated with awards below a threshold award). In another example, whenever a pitcher successfully reaches base during a baseball game (i.e., the occurrence of a game parameter modification event), the gaming table component modifies (or instructs the dealer at the gaming table to modify) the rake associated with one or more gaming tables.

In certain embodiments, upon an occurrence of a game parameter modification event, the gaming table component modifies (or instructs the dealer at the gaming table to modify) one or more activated features associated with the table game. In one such embodiment, each time a game parameter modification event occurs based on an event occurring (or not occurring) in a sporting event, the gaming table component increases or otherwise enhances the effect or magnitude of one or more activated features. For example, the first time an archer hits a bulls-eye (i.e., the occurrence of a game parameter modification event), the gaming table component cause a first joker card to be inserted into the deck of available playing cards for future plays of the table game. In this example, the second time the same archer hits a bulls-eye, the gaming table component cause a second joker card to be inserted into the deck of available playing cards for future plays of the table game.

In certain embodiments, each time a game parameter modification event occurs based on an event occurring (or not occurring) in a sporting event, the gaming table component activates (or alternatively enhances) a different feature. For example, the first time a game parameter modification event occurs based on a first touchdown being scored by the home team in a football game, the gaming table component increases a first progressive award. In this example, the second time the game parameter modification event occurs based on a second touchdown being scored by the home team in the football game, the gaming table component increase a second progressive award.

In certain embodiments, each time a game parameter modification event occurs based on an event occurring (or not occurring) in a sporting event, the gaming table component activates or deactivates the same feature. In these embodiments, the activation/deactivation of one or more features of the game are toggled on and off by the occurrences of events of a sporting event. In certain embodiments, each time a game parameter modification event occurs based on an event occurring (or not occurring) in a sporting event, the gaming table component modifies (or instructs the dealer at the gaming table to modify) a magnitude of the same feature. In these embodiments, the changes in magnitude of one or more features of the game vary based on the occurrences of events of a sporting event. For example, for a poker game associated with a professional football game, a 4× multiplier is active for the entire football game but associated with different suits of a royal flush outcome based on the specific quarter of the game such that a heart royal flush is associated with a 4× multiplier in the first quarter, a clubs royal flush is associated with a 4× multiplier in the second quarter, a diamonds royal flush is associated with a 4× multiplier in the third quarter and a spades royal flush is associated with a 4× multiplier in the fourth quarter. In another example of a poker game associated with a college baseball game, a 9× multiplier is active for the entire baseball game but associated with different four-of-a-kind hands for different innings such that four Aces is associated with a 9× multiplier in the first inning, four Twos is associated with a 9× multiplier in the second inning, four Threes is associated with a 9× multiplier for the third inning and so on.

In different embodiments, the features activated or otherwise enhanced for a table game responsive to an occurrence of a game parameter modification event include, but are not limited to: a feature which modifies one or more game outcomes of one or more plays of a game; a feature which modifies the paytable utilized for one or more plays of the game; a feature which modifies any award determined for one or more plays of the game; a feature which modifies a quantity of playing cards in a deck, a feature which modifies a quantity of cards available to be held in a hand of playing cards, a feature which modifies an automatic hold suggestion, a feature which provides an additional award amount to a player; a feature modifying an amount of credits of a credit balance; a feature modifying an amount of promotional credits; a feature modifying a rate of earning player tracking points; a feature modifying a triggering event of a play of a secondary or bonus game; a feature modifying an activation of a secondary or bonus display (such as an award generator); a feature modifying a quantity of activations of a secondary or bonus display (e.g., a feature modifying a quantity of spins of an award generator); a feature modifying a quantity of sections of a secondary or bonus display (e.g., a feature modifying a quantity of sections of an award generator); a feature modifying one or more awards of a secondary or bonus display; a feature modifying an activation of a community award generator; a feature modifying a quantity of activations of a community award generator; a feature modifying a quantity of sections of a community award generator; a feature modifying one or more awards of a community award generator; a feature modifying a generated outcome (or a designated generated outcome) in a secondary game; a feature modifying a placed wager amount; a feature modifying a placed side wager amount; a feature modifying an average expected payback percentage of a play of a game; a feature modifying an average expected payout of a play of a game; a feature modifying one or more awards available; a feature modifying a range of awards available; a feature modifying a type of awards available; a feature modifying one or more progressive awards; a feature modifying which progressive awards are available to be won; a feature modifying how one or more aspects of one or more games (e.g., colors, speeds, sound) are displayed to a player; and/or a feature modifying any game play feature associated with any play of any game disclosed herein.

In certain embodiments, different game parameter modification events result in the same modification of the same parameter of the table game. For example, if a poker game played at a gaming table is associated with a football game, a first game parameter modification event occurs whenever a first down occurs in the football game and a second game parameter modification event occurs whenever a turnover occurs in the football game, then when either a first down occurs in the football game (i.e., the first game parameter modification event occurs) or a turnover occurs in the football game (i.e., the second game parameter modification event occurs), the gaming table component classifies certain hands of playing cards as bonus game triggering hands of playing cards. In different embodiments, occurrences of different game parameter modification events result in different modifications of the table game. For example, if a poker game played at a gaming table is associated with a football game, a first game parameter modification event occurs whenever a first down occurs in the football game and a second game parameter modification event occurs whenever a turnover occurs in the football game, then when a first down occurs in the football game (i.e., the first game parameter modification event occurs), the gaming table component classifies certain hands of playing cards as bonus game triggering hands of playing cards and when a turnover occurs in the football game (i.e., the second game parameter modification event occurs), the gaming table component classifies certain playing cards as wild playing cards.

In certain embodiments, the amount or degree of modification of the game parameter is based on one or more events occurring (or not occurring) in the sporting event. For example, if a poker game played at a gaming table is associated with a live football game, the gaming table component determines that a payout for a royal flush is four-thousand credits plus the number of total yards run in the football game. It should be appreciated that any trackable statistic of any sporting event may be utilized by the gaming table component to modify a game parameter.

In certain embodiments, the event occurring in the sporting event (or the lack of the occurrence of an event in the sporting event) determines the duration which any modification of any game parameter will remain in effect. For example, upon determining that the attempted 33 yard field goal in the live football game was good, the gaming table component activates (or instructs the dealer at the gaming table to activate) a 3× multiplier for the next three minutes of game play. In certain embodiments, the amount or degree of modification of the game parameter occurs independent of any events occurring (or not occurring) in any sporting events.

In certain embodiments, if the game parameter modification event does not occur, the gaming table component does not modify a parameter of the game. In these embodiments, the lack of the occurrence of an event (or the occurrence of the event) in the sporting event causes the gaming table component not to modify the game parameter. For example, upon determining that an attempted 45 yard field goal in the live football game was missed (i.e., the game parameter modification event did not occur), the gaming table component does not alter any parameters of the associated game.

In certain embodiments, a negative event in the sporting event (or the lack of occurrence of an event in the sporting event) result in a negative modification of a game parameter. For example, upon determining that the attempted 45 yard field goal in the live football game was not good, the gaming table component reduces the value of one or more awards of a paytable currently employed for the play of a table game.

In certain embodiments, if a game parameter modification event occurs, the gaming table component modifies (or instructs the dealer at the gaming table to modify) how a game outcome is determined for one or more plays of the table game. For example, if the table game being played is a baccarat game, each of the dealer hand and the player hand are associated with a different sports team wherein the current score of each sports team is the starting value for the baccarat hand associated with that sports team. In this example, if one sports team has the score seven, the baccarat hand associated with that sports starts with seven wherein the cards dealt are added to the seven and then the second digit of the hand is the value for evaluation purposes.

Following the modification of a game parameter based on an event in a sporting event or if the gaming table component determines that a game parameter modification event did not occur based on an event in a sporting event, upon an occurrence of a table game outcome determination event, a table game outcome is determined utilizing the currently employed game parameters associated with the table game as indicated in block 108 of FIG. 1. For example, if a poker game played at a gaming table is associated with a particular team of a live football game and after determining that the particular team has possession of the football and is winning the football game with less than two minutes to go in either half (i.e., the occurrence of a game parameter modification event), the gaming table component modifies (or instructs the dealer at the gaming table to modify) all playing cards with a suit of spades to joker playing cards such that a poker hand is determined with all spade playing cards being considered joker player cards. Following the determination of a table game outcome utilizing the currently employed game parameters associated with the table game, an award associated with the determined table game outcome is determined, utilizing the currently employed game parameters associated with the table game as indicated in block 110 of FIG. 1. For example, if a poker game played at a gaming table is associated with a particular player of a live baseball game and after determining that the particular player has struck out more than five times in the baseball game (i.e., the occurrence of a game parameter modification event), the gaming table component modifies (or instructs the dealer at the gaming table to modify) all payouts associated with all poker hands including two or more playing cards with a rank of five by a 2× multiplier such that an award associated with three playing cards having a rank of five are modified by the applicable 2× multiplier.

In one embodiment, a table game outcome determination event occurs based on a displayed event associated with the play of the table game, such as upon the last player or a dealer at the gaming table taking a turn. In another embodiment, a table game outcome determination event occurs based on a displayed event occurring (or not occurring) in the displayed sporting event. For example, if the displayed sporting event is a football game, the table game outcome determination event occurs when a current drive of the football game ends. In another embodiment, a table game outcome determination event occurs based on time. In another embodiment, a table game outcome determination event occurs based on the actions of one or more other players.

In certain embodiments, the occurrence of the table game outcome determined event is conditional on the player having placed a sporting event wager on the displayed sporting event associated with that game. In certain embodiments, the occurrence of the table game outcome determination event is independent of the player having placed a sporting event wager on the displayed sporting event associated with that game. In certain embodiments, the occurrence of the table game outcome determination event is conditional on one or more parameters of the sporting event. In certain embodiments, the occurrence of the table game outcome determination event is independent of any parameters of the sporting event.

In various embodiments, the system disclosed herein employs any suitable game (including a table game, and/or a non-table game) for the play of the game occurring at or otherwise associated with a gaming table. In different embodiments, such a table game includes, but is not limited to: a play of any suitable card game, such as but not limited to any suitable poker game (including, but not limited to, Texas Hold'em, Omaha, Three Card Poker, Four Card Poker, Seven Card Stud, Pai Gow Poker, Caribbean Stud Poker, Let It Ride Poker), any suitable blackjack game, any suitable Baccarat game, any suitable Spanish 21 game, any suitable Casino War game, any suitable Super Fun 21 game, and any suitable Vegas Three Card Rummy game, a play of any suitable craps game; and/or a play of any suitable roulette game.

In certain embodiments, the duration of a modification of a game parameter is based on one or more events occurring (or not occurring) in the sporting event. In one such embodiment, the duration of a modification of a game parameter is based on a duration of part or all of the sporting event. For example, if a game is associated with a live football game and the gaming table component determines that a payout for a royal flush is four-thousand credits plus the number of total yards run in the football game, the gaming table component returns the payout for the royal flush back to four-thousand credits at the end of the game (or alternatively at the end of the quarter or after another period of time associated with the football game). In another such embodiment, the duration of a modification of a game parameter is based on an event occurring within a sporting event. For example, if a game is associated with a live football game and the gaming table component determines that a payout for a royal flush is four-thousand credits plus the number of total yards run in the football game, the gaming table component returns the payout for the royal flush back to four-thousand credits when possession of the football changes (or alternatively when a winner is determined for the football game). In certain embodiments, the duration of modification of the game parameter is determined independent of any events occurring (or not occurring) in any sporting events.

In certain embodiments, the availability of employing a modification of a game parameter is based on one or more events occurring (or not occurring) in a sporting event. For example, if a poker game played at a gaming table is associated with a particular football team of a live football game and the gaming table component determines that a payout for a flush is two-hundred credits multiplied by one plus the number of reversed referee calls in the football game, the gaming table component enables such a modification to be available to players when that particular football team has possession of the football. In this example, when that particular football team has possession of the football in the live football game, the payout for the flush is two-hundred credits multiplied by one plus the number of reversed referee calls in the football game, and when that particular team does not have possession of the football, the payout for the flush is two-hundred credits. In certain embodiments, the availability of employing a modification of the game parameter is determined independent of any events occurring (or not occurring) in any sporting events.

In certain embodiments, the system utilizes one or more leaderboards associated with one or more gaming tables associated with one or more sports teams. In these embodiments, the system causes the leaderboard to display the rankings of the sports teams based on different factors associated with the table games played in association with such sports teams, such as pot sizes, number of hands and/or bet amounts. In these embodiments, for a player to move the sports team associated with that player's gaming table up the leaderboard, that player (and/or other players at that player's gaming table) need to increase their gaming activity.

In certain embodiments, the system enables each player at each gaming table to place a secondary wager by placing a chip on a designated location, such as a location associated with electronics to detect the wager and a light indicating the state of the wager. In these embodiments, the system randomly chooses a wagering category such as yards advanced and also chooses one player from each gaming table to enter the wager, wherein the player associated with the sports team that wins the wagering category wins a supplemental award.

In certain embodiments, the system causes one or more players to each be provided a mobile device that identifies a sports team associated with that player, such as a favorite sports team. In these embodiments, upon an event occurring (or not occurring) in a sporting event being participated in by the associated sports team, such as the player's favorite sports team scoring, the mobile device flashes, vibrates, animates and/or plays a sounds to alert the player of the event. In certain other embodiments, the system utilizes the provided mobile device to indicate to the player that they have won an award, such as the player being randomly selected to win a progressive award because the player's favorite sports team won a game.

In one embodiment, the gaming table component provides a group gaming aspect to the games disclosed herein. In one such embodiment, the game is a cooperative community game wherein a plurality of players cooperate or play together in a play of a game which relates to one or more events occurring (or not occurring) in a corresponding sporting event. In another such embodiment, the games disclosed herein a competition community game wherein a plurality of players compete or player against each other in a play of a game which relates to one or more events occurring (or not occurring) in a corresponding sporting event.

Alternative Embodiments

It should be appreciated that in different embodiments, one or more of:

i. when a sporting event display condition is satisfied;
ii. when a table game parameter modification event occurs;
iii. which available sporting event to display;
iv. whether to utilize a historic sporting event, a live sporting event, a simulated sporting event and/or an electronic sporting event;
v. which sporting event(s), sports team(s) and/or sporting event participant(s) to associate with modifying which parameters of a table game;
vi. which event(s) or non-event(s) of which sporting events to associate with modifying which parameters of a table game
vii. which parameters of a table game to modify based on one or more events occurring (or not occurring) in one or more sporting events;
viii. a quantity of parameters of a table game to modify based on one or more events occurring (or not occurring) in one or more sporting events;
ix. a duration to modify one or more parameters of a table game based on one or more events occurring (or not occurring) in one or more sporting events;
x. how much to modify one or more parameters of a table game based on one or more events occurring (or not occurring) in one or more sporting events;
xi. what type of table game to modify zero, one or more parameters of; and/or
xii. any determination disclosed herein;

is/are predetermined, randomly determined, randomly determined based on one or more weighted percentages, determined based on a generated symbol or symbol combination, determined independent of a generated symbol or symbol combination, determined based on a random determination by the central controller, determined independent of a random determination by the central controller, determined based on a random determination at the gaming table component, determined independent of a random determination at the gaming table component, determined based on at least one play of at least one game, determined independent of at least one play of at least one game, determined based on a player's selection, determined independent of a player's selection, determined based on one or more side wagers placed, determined independent of one or more side wagers placed, determined based on the player's primary game wager, determined independent of the player's primary game wager, determined based on time (such as the time of day), determined independent of time (such as the time of day), determined based on an amount of coin-in accumulated in one or more pools, determined independent of an amount of coin-in accumulated in one or more pools, determined based on a status of the player (i.e., a player tracking status), determined independent of a status of the player (i.e., a player tracking status), determined based on one or more other determinations disclosed herein, determined independent of any other determination disclosed herein or determined based on any other suitable method or criteria.

Gaming Table Components

The above-described embodiments of the present disclosure may be implemented in accordance with or in conjunction with one or more of a variety of different types of gaming table components which operate with zero, one or more servers to cause zero, one or more events occurring (or not occurring) in one or more sporting events to influence zero, one or more aspects of one or more games played at a gaming table including or otherwise associated with the gaming table component.

Figure 4:
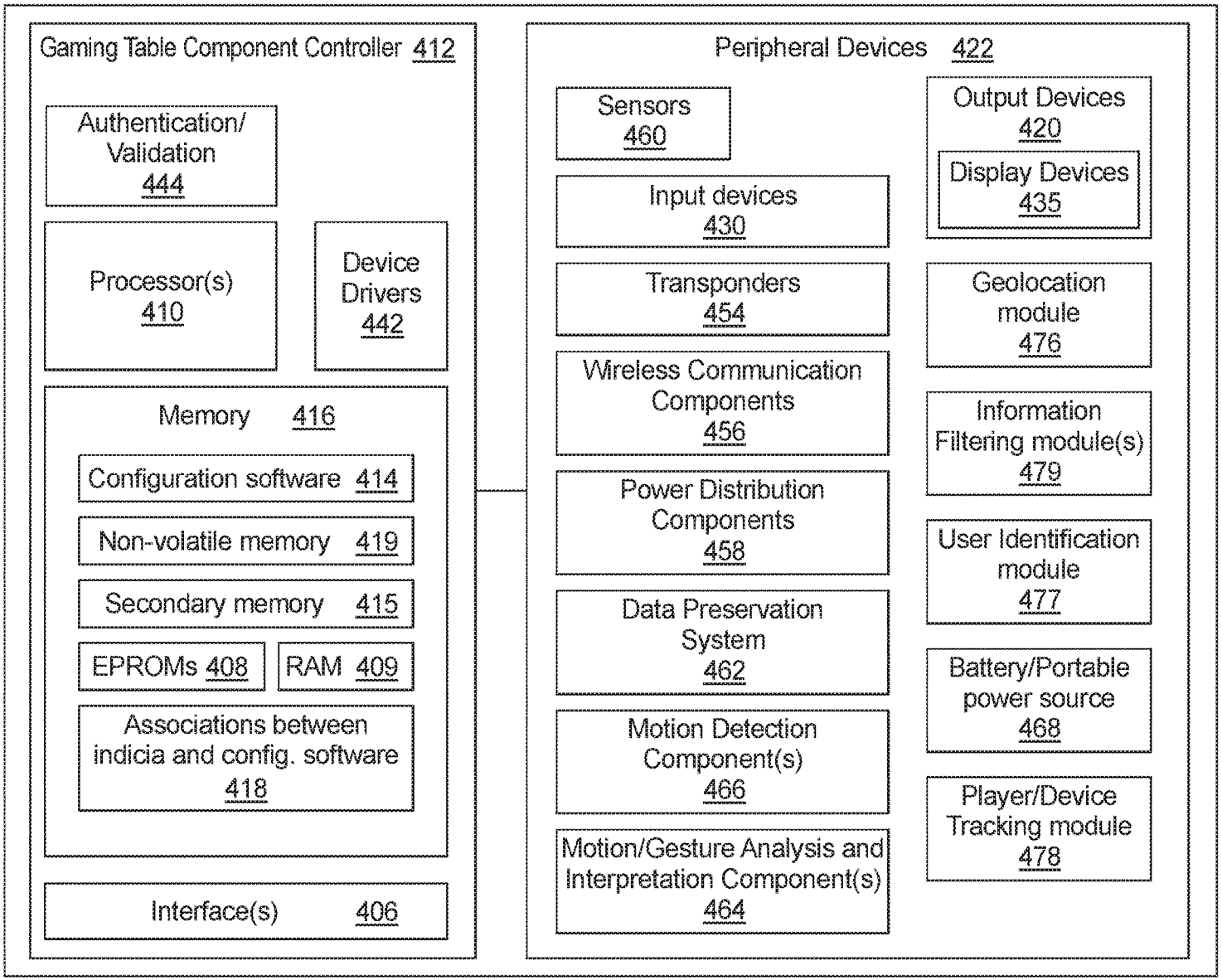
FIG. 4 is a schematic block diagram of one embodiment of a gaming table component of an example system disclosed herein.

In certain embodiments, as seen in FIG. 4, the gaming table component 400 includes a gaming table component controller 412 configured to communicate with and to operate with a plurality of peripheral devices 422.

The gaming table component controller 412 includes at least one processor 410. The at least one processor 410 is any suitable processing device or set of processing devices, such as a microprocessor, a microcontroller-based platform, a suitable integrated circuit, or one or more application-specific integrated circuits (ASICs), configured to execute software enabling various configuration and reconfiguration tasks, such as: (1) communicating with a remote source (such as a server that stores authentication information) via a communication interface 406 of the gaming table component controller 412; (2) converting signals read by an interface to a format corresponding to that used by software or memory of the gaming table component; (3) accessing memory to configure or reconfigure parameters in the memory according to indicia read from the gaming table component; (4) communicating with interfaces and the peripheral devices 422 (such as input/output devices); and/or (5) controlling the peripheral devices 422. In certain embodiments, one or more components of the gaming table component controller 412 (such as the at least one processor 410) reside within a housing of the gaming table component (described below), while in other embodiments at least one component of the gaming table component controller 412 resides outside of the housing of the gaming table component.

The gaming table component controller 412 also includes at least one memory device 416, which includes: (1) volatile memory (e.g., RAM 409, which can include non-volatile RAM, magnetic RAM, ferroelectric RAM, and any other suitable forms); (2) non-volatile memory 419 (e.g., disk memory, FLASH memory, EPROMs, EEPROMs, memristor-based non-volatile solid-state memory, etc.); (3) unalterable memory (e.g., EPROMs 408); (4) read-only memory; and/or (5) a secondary memory storage device 415, such as a non-volatile memory device, configured to store gaming software related information (the software related information and the memory may be used to store various audio files not currently being used and invoked in a configuration or reconfiguration). Any other suitable magnetic, optical, and/or semiconductor memory may operate in conjunction with the gaming table component disclosed herein. In certain embodiments, the at least one memory device 416 resides within the housing of the gaming table component (described below), while in other embodiments at least one component of the at least one memory device 416 resides outside of the housing of the gaming table component.

The at least one memory device 416 is configured to store, for example: (1) configuration software 414, such as all the parameters and settings on the gaming table component; (2) associations 418 between configuration indicia read from a gaming table component with one or more parameters and settings; (3) communication protocols configured to enable the at least one processor 410 to communicate with the peripheral devices 422; and/or (4) communication transport protocols (such as TCP/IP, USB, Firewire, IEEE1394, Bluetooth, IEEE 802.11x (IEEE 802.11 standards), hiperlan/2, HomeRF, etc.) configured to enable the gaming table component to communicate with local and non-local devices using such protocols. In one implementation, the gaming table component controller 412 communicates with other devices using a serial communication protocol. A few non-limiting examples of serial communication protocols that other devices, such as peripherals (e.g., a bill validator or a ticket printer), may use to communicate with the gaming table component controller 412 include USB, RS-242, and Netplex (a proprietary protocol developed by IGT).

As will be appreciated by one skilled in the art, aspects of the present disclosure may be illustrated and described herein in any of a number of patentable classes or context including any new and useful process, machine, manufacture, or composition of matter, or any new and useful improvement thereof. Accordingly, aspects of the present disclosure may be implemented entirely hardware, entirely software (including firmware, resident software, microcode, etc.) or combining software and hardware implementation that may all generally be referred to herein as a "circuit," "module," "component," or "system." Furthermore, aspects of the present disclosure may take the form of a computer program product embodied in one or more computer readable media having computer readable program code embodied thereon.

Computer program code for carrying out operations for aspects of the present disclosure may be written in any combination of one or more programming languages, including an object oriented programming language such as Java, Scala, Smalltalk, Eiffel, JADE, Emerald, C++, C#, VB.NET, Python or the like, conventional procedural programming languages, such as the "C" programming language, Visual Basic, Fortran 2003, Perl, COBOL 2002, PHP, ABAP, dynamic programming languages such as Python, Ruby and Groovy, or other programming languages. The program code may execute entirely on the user's computer, partly on the user's computer, as a stand-alone software package, partly on the user's computer and partly on a remote computer or entirely on the remote computer or server. In the latter scenario, the remote computer may be connected to the user's computer through any type of network, including a local area network (LAN) or a wide area network (WAN), or the connection may be made to an external computer (for example, through the Internet using an Internet Service Provider) or in a cloud computing environment or offered as a service such as a Software as a Service (SaaS).

Aspects of the present disclosure are described herein with reference to flowchart illustrations and/or block diagrams of methods, apparatuses (systems) and computer program products according to embodiments of the disclosure. It will be understood that each block of the flowchart illustrations and/or block diagrams, and combinations of blocks in the flowchart illustrations and/or block diagrams, can be implemented by computer program instructions. These computer program instructions may be provided to a processor of a general purpose computer, special purpose computer, or other programmable data processing apparatus to produce a machine, such that the instructions, which execute via the processor of the computer or other programmable instruction execution apparatus, create a mechanism for implementing the functions/acts specified in the flowchart and/or block diagram block or blocks.

These computer program instructions may also be stored in a computer readable medium that when executed can direct a computer, other programmable data processing apparatus, or other devices to function in a particular manner, such that the instructions when stored in the computer readable medium produce an article of manufacture including instructions which when executed, cause a computer to implement the function/act specified in the flowchart and/or block diagram block or blocks. The computer program instructions may also be loaded onto a computer, other programmable instruction execution apparatus, or other devices to cause a series of operational steps to be performed on the computer, other programmable apparatuses or other devices to produce a computer implemented process such that the instructions which execute on the computer or other programmable apparatus provide processes for implementing the functions/acts specified in the flowchart and/or block diagram block or blocks.

In certain embodiments, the at least one memory device 416 is configured to store program code and instructions executable by the at least one processor of the gaming table component to control the gaming table component. The at least one memory device 416 of the gaming table component also stores other operating data, such as image data, event data, input data, or information, and/or applicable rules on the gaming table component. In various embodiments, part or all of the program code and/or the operating data described above is stored in at least one detachable or removable memory device including, but not limited to, a cartridge, a disk, a CD ROM, a DVD, a USB memory device, or any other suitable non-transitory computer readable medium. In certain such embodiments, an operator (such as a gaming establishment operator) and/or a player uses such a removable memory device in a gaming table component to implement at least part of the present disclosure. In other embodiments, part or all of the program code and/or the operating data is downloaded to the at least one memory device of the gaming table component through any suitable data network described above (such as an Internet or intranet).

The at least one memory device 416 also stores a plurality of device drivers 442. Examples of different types of device drivers include device drivers for gaming table component components and device drivers for the peripheral components 422. Typically, the device drivers 442 utilize various communication protocols that enable communication with a particular physical device. The device driver abstracts the hardware implementation of that device. For example, a device driver may be written for each type of card reader that could potentially be connected to the gaming table component. Non-limiting examples of communication protocols used to implement the device drivers include Netplex, USB, Serial, Ethernet 175, Firewire, I/O debouncer, direct memory map, serial, PCI, parallel, RF, Bluetooth™, near-field communications (e.g., using near-field magnetics), 802.11 (WiFi), etc. In one embodiment, when one type of a particular device is exchanged for another type of the particular device, the at least one processor of the gaming table component loads the new device driver from the at least one memory device to enable communication with the new device. For instance, one type of card reader in the gaming table component can be replaced with a second different type of card reader when device drivers for both card readers are stored in the at least one memory device.

In certain embodiments, the software units stored in the at least one memory device 416 can be upgraded as needed. For instance, when the at least one memory device 416 is a hard drive, new parameters, new settings for existing parameters, new settings for new parameters, new device drivers, and new communication protocols can be uploaded to the at least one memory device 416 from the gaming table component controller 412 or from some other external device. As another example, when the at least one memory device 416 includes a CD/DVD drive including a CD/DVD configured to store options, parameters, and settings, the software stored in the at least one memory device 416 can be upgraded by replacing a first CD/DVD with a second CD/DVD. In yet another example, when the at least one memory device 416 uses flash memory 419 or EPROM 408 units configured to store options, parameters, and settings, the software stored in the flash and/or EPROM memory units can be upgraded by replacing one or more memory units with new memory units that include the upgraded software. In another embodiment, one or more of the memory devices, such as the hard drive, may be employed in a software download process from a remote software server.

In some embodiments, the at least one memory device 416 also stores authentication and/or validation components 444 configured to authenticate/validate specified gaming table component components and/or information, such as hardware components, software components, firmware components, peripheral device components, user input device components, information received from one or more user input devices, information stored in the at least one memory device 416, etc.

In certain embodiments, the peripheral devices 422 include several device interfaces, such as: (1) at least one output device 420 including at least one display device 435; (2) at least one input device 430 (which may include contact and/or non-contact interfaces); (3) at least one transponder 454; (4) at least one wireless communication component 456; (5) at least one wired/wireless power distribution component 458; (6) at least one sensor 460; (7) at least one data preservation component 462; (8) at least one motion/gesture analysis and interpretation component 464; (9) at least one motion detection component 466; (10) at least one portable power source 468; (11) at least one geolocation module 476; (12) at least one user identification module 477; (13) at least one player/device tracking module 478; and (14) at least one information filtering module 479.

The at least one output device 420 includes at least one display device 435 configured to display any displayed by the gaming table component and any suitable information. In certain embodiments, the display devices are connected to or mounted on a housing of the gaming table component (described below).

In various embodiments, the display devices include, without limitation: a monitor, a television display, a plasma display, a liquid crystal display (LCD), a display based on light emitting diodes (LEDs), a display based on a plurality of organic light-emitting diodes (OLEDs), a display based on polymer light-emitting diodes (PLEDs), a display based on a plurality of surface-conduction electron-emitters (SEDs), a display including a projected and/or reflected image, or any other suitable electronic device or display mechanism. In certain embodiments, as described above, the display device includes a touch-screen with an associated touch-screen controller. The display devices may be of any suitable sizes, shapes, and configurations.

In certain embodiments, the at least one output device 420 is a sound generating device controlled by one or more sound cards. In one such embodiment, the sound generating device includes one or more speakers or other sound generating hardware and/or software configured to generate sounds.

The at least one input device 430 may include any suitable device that enables an input signal to be produced and received by the at least one processor 410 of the gaming table component.

In various embodiments, the at least one input device 430 includes a plurality of buttons that are programmable by the gaming table component operator to, when actuated, cause the gaming table component to perform particular functions. In certain embodiments, the at least one input device 430 includes a touch-screen coupled to a touch-screen controller or other touch-sensitive display overlay to enable interaction with any images displayed on a display device (as described below). One such input device is a conventional touch-screen button panel. The touch-screen and the touch-screen controller are connected to a video controller. In these embodiments, signals are input to the gaming table component by touching the touch screen at the appropriate locations.

In embodiments including a player tracking system, as further described below, the at least one input device 430 includes a card reader in communication with the at least one processor of the gaming table component.

The at least one wireless communication component 456 includes one or more communication interfaces having different architectures and utilizing a variety of protocols, such as (but not limited to) 802.11 (WiFi); 802.15 (including Bluetooth™); 802.16 (WiMax); 802.22; cellular standards such as CDMA, CDMA2000, and WCDMA; Radio Frequency (e.g., RFID); infrared; and Near Field Magnetic communication protocols. The at least one wireless communication component 456 transmits electrical, electromagnetic, or optical signals that carry digital data streams or analog signals representing various types of information.

The at least one wired/wireless power distribution component 458 includes components or devices that are configured to provide power to other devices. For example, in one embodiment, the at least one power distribution component 458 includes a magnetic induction system that is configured to provide wireless power to one or more user input devices near the gaming table component. In one embodiment, a user input device docking region is provided, and includes a power distribution component that is configured to recharge a user input device without requiring metal-to-metal contact. In one embodiment, the at least one power distribution component 458 is configured to distribute power to one or more internal components of the gaming table component, such as one or more rechargeable power sources (e.g., rechargeable batteries) located at the gaming table component.

In certain embodiments, the at least one sensor 460 includes at least one of: optical sensors, pressure sensors, RF sensors, infrared sensors, image sensors, thermal sensors, and biometric sensors. The at least one sensor 460 may be used for a variety of functions, such as: detecting movements and/or gestures of various objects within a predetermined proximity to the gaming table component; detecting the presence and/or identity of various persons (e.g., players, casino employees, etc.), devices (e.g., user input devices), and/or systems within a predetermined proximity to the gaming table component.

The at least one data preservation component 462 is configured to detect or sense one or more events and/or conditions that, for example, may result in damage to the gaming table component and/or that may result in loss of information associated with the gaming table component. Additionally, the data preservation system 462 may be operable to initiate one or more appropriate action(s) in response to the detection of such events/conditions.

The at least one motion/gesture analysis and interpretation component 464 is configured to analyze and/or interpret information relating to detected player movements and/or gestures to determine appropriate player input information relating to the detected player movements and/or gestures. For example, in one embodiment, the at least one motion/gesture analysis and interpretation component 464 is configured to perform one or more of the following functions: analyze the detected gross motion or gestures of a player; interpret the player's motion or gestures to identify instructions or input from the player. In other embodiments, at least a portion of these additional functions may be implemented at a remote system or device.

The at least one portable power source 468 enables the gaming table component to operate in a mobile environment. For example, in one embodiment, the gaming table component 400 includes one or more rechargeable batteries.

The at least one geolocation module 476 is configured to acquire geolocation information from one or more remote sources and use the acquired geolocation information to determine information relating to a relative and/or absolute position of the gaming table component. For example, in one implementation, the at least one geolocation module 476 is configured to receive GPS signal information for use in determining the position or location of the gaming table component. In another implementation, the at least one geolocation module 476 is configured to receive multiple wireless signals from multiple remote devices (e.g., gaming table components, servers, wireless access points, etc.) and use the signal information to compute position/location information relating to the position or location of the gaming table component.

The at least one user identification module 477 is configured to determine the identity of any current players at the gaming table associated with the gaming table component. For example, in one embodiment, the current players at the gaming table associated with the gaming table component are each required to perform a login process at the gaming table component in order to access one or more features. Alternatively, the gaming table component is configured to automatically determine the identity of such players based on one or more external signals, such as an RFID tag that provides a wireless signal to the gaming table component that is used to determine the identity of the player. In at least one embodiment, various security features are incorporated into the gaming table component to prevent unauthorized users from accessing confidential or sensitive information.

The at least one information filtering module 479 is configured to perform filtering (e.g., based on specified criteria) of selected information to be displayed at one or more displays 435 of the gaming table component.

In various embodiments, the gaming table component includes a plurality of communication ports configured to enable the at least one processor of the gaming table component to communicate with and to operate with external peripherals, such as: accelerometers, arcade sticks, bar code readers, bill validators, biometric input devices, button panels, card readers, coin dispensers, coin hoppers, display screens or other displays or video sources, expansion buses, information panels, keypads, lights, mass storage devices, microphones, motion sensors, motors, printers, reels, SCSI ports, solenoids, speakers, thumbsticks, ticket readers, touch screens, trackballs, touchpads, wheels, and wireless communication devices.

In various embodiments, in addition to or alternative from the gaming table component communicating to an EGM data associated with the play of the table game occurring at the associated gaming table (such that the EGM enables a player to participate in the play of the table game remote from the gaming table), the gaming table component includes or is associated with one or more servers configured to communicate with a personal gaming device—such as a smartphone, a tablet computer, a desktop computer, or a laptop computer—to enable web-based game play using the personal gaming device. In various embodiments, the player must first access a gaming website via an Internet browser of the personal gaming device or execute an application (commonly called an "app") installed on the personal gaming device before the player can use the personal gaming device to participate in web-based game play. In certain embodiments, the one or more servers and the personal gaming device operate in a thin-client environment. In these embodiments, the personal gaming device receives inputs via one or more input devices (such as a touch screen and/or physical buttons), the personal gaming device sends the received inputs to the one or more servers, the one or more servers make various determinations based on the inputs and determine content to be displayed (such as a randomly determined game outcome and corresponding award), the one or more servers send the content to the personal gaming device, and the personal gaming device displays the content.

In certain such embodiments, the one or more servers must identify the player before enabling game play on the personal gaming device (or, in some embodiments, before enabling monetary wager-based game play on the personal gaming device). In these embodiments, the player must identify herself to the one or more servers, such as by inputting the player's unique playername and password combination, providing an input to a biometric sensor (e.g., a fingerprint sensor, a retinal sensor, a voice sensor, or a facial-recognition sensor), or providing any other suitable information.

Once identified, the one or more servers enable the player to establish an account balance from which the player can draw credits usable to wager on plays of a game. In certain embodiments, the one or more servers enable the player to initiate an electronic funds transfer to transfer funds from a bank account to the player's account balance. In other embodiments, the one or more servers enable the player to make a payment using the player's credit card, debit card, or other suitable device to add money to the player's account balance. In other embodiments, the one or more servers enable the player to add money to the player's account balance via a peer-to-peer type application, such as PayPal or Venmo. The one or more servers also enable the player to cash out the player's account balance (or part of it) in any suitable manner, such as via an electronic funds transfer, by initiating creation of a paper check that is mailed to the player, or by initiating printing of a voucher at a kiosk in a gaming establishment.

In certain embodiments, the one or more servers include a payment server that handles establishing and cashing out players' account balances and a separate game server configured to determine the outcome and any associated award for a play of a game. In these embodiments, the game server is configured to communicate with the personal gaming device and the payment device, and the personal gaming device and the payment device are not configured to directly communicate with one another. In these embodiments, when the game server receives data representing a request to start a play of a game at a desired wager, the game server sends data representing the desired wager to the payment server. The payment server determines whether the player's account balance can cover the desired wager (i.e., includes a monetary balance at least equal to the desired wager).

If the payment server determines that the player's account balance cannot cover the desired wager, the payment server notifies the game server, which then instructs the personal gaming device to display a suitable notification to the player that the player's account balance is too low to place the desired wager. If the payment server determines that the player's account balance can cover the desired wager, the payment server deducts the desired wager from the account balance and notifies the game server. The game server then determines an outcome and any associated award for the play of the game. The game server notifies the payment server of any nonzero award, and the payment server increases the player's account balance by the nonzero award. The game server sends data representing the outcome and any award to the personal gaming device, which displays the outcome and any award.

In certain embodiments, the one or more servers enable web-based game play using a personal gaming device only if the personal gaming device satisfies one or more jurisdictional requirements. In one embodiment, the one or more servers enable web-based game play using the personal gaming device only if the personal gaming device is located within a designated geographic area (such as within certain state or county lines or within the boundaries of a gaming establishment). In this embodiment, the geolocation module of the personal gaming device determines the location of the personal gaming device and sends the location to the one or more servers, which determine whether the personal gaming device is located within the designated geographic area. In various embodiments, the one or more servers enable non-monetary wager-based game play if the personal gaming device is located outside of the designated geographic area.

In various embodiments, the gaming table component is configured to communicate with a personal gaming device—such as a smartphone, a tablet computer, a desktop computer, or a laptop computer—to enable tethered mobile game play using the personal gaming device. Generally, in these embodiments, the gaming table component establishes communication with the personal gaming device and enables the player to play games being played at a gaming table remotely via the personal gaming device. In certain embodiments, the gaming table component includes or is otherwise associated with a geo-fence system that enables tethered game play within a particular geographic area but not outside of that geographic area.

In certain embodiments, the gaming table component is configured to communicate with a social network server that hosts or partially hosts a social networking website via a data network (such as the Internet) to integrate a player's gaming experience with the player's social networking account. This enables the gaming table component to send certain information to the social network server that the social network server can use to create content (such as text, an image, and/or a video) and post it to the player's wall, newsfeed, or similar area of the social networking website accessible by the player's connections (and in certain cases the public) such that the player's connections can view that information. This also enables the gaming table component to receive certain information from the social network server, such as the player's likes or dislikes or the player's list of connections. In certain embodiments, the gaming table component enables the player to link the player's player account to the player's social networking account(s). This enables the gaming table component to, once it identifies the player and initiates a gaming session (such as via the player logging in to a website (or an application) on the player's personal gaming device or via the player inserting the player's player tracking card), link that gaming session to the player's social networking account(s). In other embodiments, the gaming table component enables the player to link the player's social networking account(s) to individual gaming sessions when desired by providing the required login information.

For instance, in one embodiment, if a player wins a particular award (e.g., a progressive award or a jackpot award) or an award that exceeds a certain threshold (e.g., an award exceeding $1,000), the gaming table component sends information about the award to the social network server to enable the server to create associated content (such as a screenshot of the outcome and associated award) and to post that content to the player's wall (or other suitable area) of the social networking website for the player's connections to see (and to entice them to play). In another embodiment, if a player joins a multiplayer game and there is another seat available, the gaming table component sends that information to the social network sever to enable the server to create associated content (such as text indicating a vacancy for that particular game) and to post that content to the player's wall (or other suitable area) of the social networking website for the player's connections to see (and to entice them to fill the vacancy). In another embodiment, if the player consents, the gaming table component sends advertisement information or offer information to the social network server to enable the social network server to create associated content (such as text or an image reflecting an advertisement and/or an offer) and to post that content to the player's wall (or other suitable area) of the social networking website for the player's connections to see. In another embodiment, the gaming table component enables the player to recommend a game to the player's connections by posting a recommendation to the player's wall (or other suitable area) of the social networking website.

Gaming Tables

In certain embodiments, as indicated above, the system employs one or more intelligent gaming tables or gaming chip tracking systems. In one embodiment, each intelligent gaming table enables one or more players to play one or more suitable games by placing one or more wagers utilizing such gaming chips. Such game play and/or wagering information is tracked by the intelligent gaming table and provided to a central server. In another embodiment, the central server is in communication with at least one player tracking system to identify at least one player currently placing at least one wager on at least one suitable game at at least one of the intelligent gaming tables in the system.

In another embodiment, the gaming tables utilized in the system are non-intelligent gaming tables wherein the gaming chip identification devices are not directly integrated or situated in or on the gaming tables. In this embodiment, one or more gaming chip identification devices are utilized to track each player's wagered gaming chips. In one such embodiment, gaming chip identification devices are located at, above or below the table. In another such embodiment, the gaming chip identification devices are attached to the gaming table or adjacent to the gaming table. In another such embodiment, the gaming chip identification devices are included in the gaming table. In these embodiments, gaming establishments do not have to purchase new gaming tables. Rather, gaming establishments may continue using the same gaming tables and install the intelligent table technology around one or more gaming tables.

In one embodiment, referring back to FIG. 2, a gaming table 202 includes a suitable support structure 204, such as one or more legs, a playing surface 206 and a dealer position 208. In one embodiment, the dealer position includes two different gaming chip trays 210 and 212 for holding several stacks of the dealer's gaming chips. The dealer may use the gaming chip trays to collect and store gaming chips, make change for a player, and/or distribute gaming chips upon a gaming chip distribution event associated with the gaming table component (not shown). The gaming table includes a plurality of player stations or seats 214*a*, 214*b*, 214*c*, 214*d* and 214*e*. In this example, there are five player stations or seats. It should be appreciated that the gaming table may accommodate any suitable number of player positions and players so as not to interfere with game play. In one embodiment, the gaming table includes a plurality of gaming chip holding areas 216*a*, 216*b*, 216*c*, 216*d* and 216*e* where the players hold their gaming chips. In certain embodiment, the gaming tables include wagering areas (not illustrated) where players place their bets. It should be appreciated that the gaming table may also include a community wagering area (not illustrated) where each of the players place their wagers. In one embodiment, the gaming table also includes a plurality of playing areas 218*a*, 218*b*, 218*c*, 218*d* and 218*e* associated with each of the player stations.

In one embodiment, cards are dealt by the dealer substantially within the respective playing areas, such that cards dealt to a first player position are not confused with cards dealt to a second different player position. It should be appreciated that games played at the gaming tables may include any suitable card game or any suitable non-card game, such as roulette and craps. The gaming tables are operable to include any suitable apparatuses or components of the games. It should be appreciated that different gaming tables in the system may include the same game components or different game components.

In one embodiment, one or more gaming tables in the system each include at least one processor and at least one memory device, including, but not limited to the processors and memory devices of the gaming table component described above. In one embodiment, the system of gaming tables is integrated with one or more player tracking systems. In this embodiment, the system and/or player tracking system is operable to track any participating player's gaming activity at each gaming table of the system. In one such embodiment, the system and/or the associated player tracking system timely tracks when a player inserts their playing tracking card to begin a gaming session and also timely tracks when a player removes their player tracking card, stops playing at the gaming table or cashes out when concluding play for that gaming session. In another embodiment, the dealer or host logs the player in and out. In one such embodiment, at the start of a gaming session, the player hands the player's tracking card to the dealer and the dealer or host logs the player in and out for a gaming session. In different embodiments, the system works in accordance with the player tracking system to maintain data about players.

In other embodiments, rather than requiring a player to insert a player tracking card or enter identifying information, the gaming table utilizes one or more portable devices carried by a player, such as a cell phone, email communication device, a radio frequency identification tag or any other suitable wireless device to track when a player begins and ends a gaming session. In other embodiments, the gaming table utilizes any suitable biometric technology or ticket technology to track when a player begins and ends a gaming session. Each of the gaming tables may include any suitable number of player tracking input devices, such as card readers or key pads to enter identification numbers. In one embodiment, each player station or seat includes an individual player tracking input device. In another embodiment, a gaming table includes a single player tracking input device. In another embodiment, only a dealer has access to the player tracking input device and inputs all of each player's information.

It should be appreciated that the intelligent table system disclosed herein may include any suitable components or devices to monitor the players' gaming activity. That is, the intelligent table systems tracks how much a player wagers or how many gaming chips a player wagers, how much a player has won or lost, how many gaming chips the player has on the gaming table, or any other desired tracking information. In one embodiment, the intelligent table system also tracks this information for each and every game played by the player. It should be appreciated that the intelligent table system may include any suitable gaming table areas with gaming chip identification devices, any suitable method of identifying the gaming chips, and may use any suitable gaming chip reading technology.

In one embodiment, the intelligent gaming tables or gaming chip tracking systems tracks, monitors and records game play occurring at one or more gaming table player stations, regardless of which player is currently playing at each gaming station. In another embodiment, the intelligent gaming tables or gaming chip tracking systems tracks, monitors and records game play of one or more players at such gaming tables. In this embodiment, the player tracking system identifies players and records or saves the game play information provided by the intelligent tables in specific player accounts.

In another embodiment, the intelligent gaming table disclosed herein employs a virtual gaming table. The virtual gaming table provide virtual playing cards and/or virtual gaming chips which enable one or more players to play one or more games at the intelligent gaming table. In one embodiment, such virtual gaming tables can utilize one or more surface computing mechanisms, one or more cameras and one or more of a plurality of display devices to provide these games. In one such embodiment, an intelligent gaming table includes an acrylic top and employs a plurality of infrared cameras and a DLP projector with wireless networks to display and detect objects and movement. In this embodiment, as players move their hands or objects on the table top, the cameras translate the motions into commands.

It should be appreciated that values may be assigned to gaming chips in any suitable manner. In one embodiment, different denominations of gaming chips are visually different, such as having the value displayed on the gaming chip, having different sizes and/or having different weights. In another such embodiment, each gaming chip is associated with one of a plurality of different values. In this embodiment, the intelligent table system identifies the individual gaming chips (such as using RFID technology described herein), determines the placement of each gaming chip and sends the information to the player tracking system or central controller about each of the specific gaming chips. In one embodiment, the central server associates the value of the gaming chip with the player tracking account.

In one embodiment, each of the gaming chips has or is associated with an identification number. The intelligent table system determines the gaming chip identification number upon play or win of a gaming chip or upon the evaluation of all of the gaming chips in a player's gaming chip identification area. The intelligent table system sends the gaming chip information to the central server. The system associates the gaming chip number with the amount and the player. For example, a first player's gaming chip identification area includes gaming chip number 876543 which is associated with the value of $1, gaming chip number 876545 which is associated with the value of $5 and gaming chip number 876547 which is associated with the value of $10. In one embodiment, the intelligent table system determines which gaming chips are in which identification area and sends the information to the central server. The system associates the gaming chip numbers with their value and uses the information to determine one or more aspects of game play.

The intelligent table system disclosed herein is operable to use a variety of types of technology to track player activity. More specifically, in one embodiment, the intelligent table system is operable to include one or more gaming chip identifying devices. In one embodiment, the intelligent table system uses Infra-red signals received from table game gaming chips to track activity. In another embodiment, as indicated above, the intelligent table system employs RFID to track gaming chip activity. The RFID is a system that uses a small electronic device that includes a small gaming chip and an antenna. The gaming chips are scanned at the gaming table to retrieve the identifying information. In another embodiment, the system uses optical technology. The system may use any suitable other gaming chip identification devices, which may use any suitable gaming chip identification technology, to determine player gaming table wagering activities. The gaming chips are tracked for total gaming chip movement or wins and losses. When each gaming chip is placed in a gaming chip identification area, such as a betting circle or in a player's betting or wagering area, gaming chip identification devices recognizes the gaming chip and relays this data to the intelligent table system.

The system disclosed herein contemplates a plurality of different methods that the gaming chips may be used and/or identified during game play. In one embodiment, a gaming chip identification area is a gaming chip holding area. In one embodiment, intelligent table system identifies all of the gaming chips in a player's gaming chip holding area. For example, during game play, a player is required to have all gaming chips in that player's possession in a gaming chip holding area which each include one or more gaming chip identification devices. Upon a game play checkpoint, such as at a designated time interval, upon a triggering event, at the end of a play of a game or at the end of a gaming session, the intelligent table system surveys each of the player's gaming chip holding areas to identify the players' gaming chips.

In one embodiment, the gaming chip identification area is a wagering area. In one embodiment, the system includes gaming chip identification devices in each player's wagering area. The system identifies either the specific gaming chips wagered and won or loss by that player or the number of gaming chips wagered and won or loss by the player. For example, a player logs into the player tracking system via a card slot at the player's player station at a gaming table. When a player places a gaming chip in the wagering area associated with that player station, the intelligent table system identifies that gaming chip. When a dealer or host provides a gaming chip to a player for a win, the intelligent table system identifies the gaming chip.

In another embodiment, both the gaming chip holding area and the wagering area include gaming chip identification devices. That is, the system is operable to identify gaming chips in both the gaming chip holding area and the wagering area. Therefore, the system double checks or verifies each player's gaming activity.

In one embodiment, the system associates the gaming activity directly with players via player accounts. For example, at the start of play, the player logs into the player tracking system, such as by inserting a player tracking card into a card reader associated with their player station on the gaming table. In this embodiment, the intelligent table system associates any tracked data with the player's specific account. Thus, in certain embodiments, tracking player activity at the gaming table is similar in accuracy and thoroughness to the tracking done at slot machines.

Alternatively, the system determines the gaming chip count at each player station. That is, the system enables players to play anonymously and be associated with their current place at the table. For example, a player does not have to log in for one or more plays of a game but rather remains at a same player station for such plays of the game. The system associates the gaming chips with the player stations.

In certain embodiments, the intelligent table system includes one or more card readers or a card reading system. The card reading system knows what card comes out of the shoe and is dealt to what player. In one embodiment, the card reading system is a part of the intelligent table system. In another embodiment, the card reading system is separate from the intelligent table system and in association with the intelligent table system detects betting patterns and decisions to provide to the player tracking system. Such betting patterns and decisions may qualify the player to win one or more bonus awards. The card reading system can also reduce dealer error and or possible corruption by making sure that the players are paid properly for each and every hand. In certain embodiments, the intelligent table system knows the player cards, the dealer cards, and the bet, the intelligent table system is enabled to determine correct payouts for each and every player at the gaming table. In certain embodiments, the system employs safeguards to make sure the correct payout is made. For example, the system can send a halt play signal if an error is detected. It should be appreciated that in different embodiments the card reading system and the intelligent table system are integrated with or included in one or more tracking systems or player tracking systems.

It should be appreciated that the terminology used herein is for the purpose of describing particular aspects only and is not intended to be limiting of the disclosure. For example, the singular forms "a", "an" and "the" are intended to include the plural forms as well, unless the context clearly indicates otherwise. In another example, the terms "including" and "comprising" and variations thereof, when used in this specification, specify the presence of stated features, steps, operations, elements, and/or components, but do not preclude the presence or addition of one or more other features, steps, operations, elements, components, and/or groups thereof. Additionally, a listing of items does not imply that any or all of the items are mutually exclusive nor does a listing of items imply that any or all of the items are collectively exhaustive of anything or in a particular order, unless expressly specified otherwise. Moreover, as used herein, the term "and/or" includes any and all combinations of one or more of the associated listed items. It should be further appreciated that headings of sections provided in this document and the title are for convenience only, and are not to be taken as limiting the disclosure in any way. Furthermore, unless expressly specified otherwise, devices that are in communication with each other need not be in continuous communication with each other and may communicate directly or indirectly through one or more intermediaries.

Various changes and modifications to the present embodiments described herein will be apparent to those skilled in the art. For example, a description of an embodiment with several components in communication with each other does not imply that all such components are required, or that each of the disclosed components must communicate with every other component. On the contrary a variety of optional components are described to illustrate the wide variety of possible embodiments of the present disclosure. As such, these changes and modifications can be made without departing from the spirit and scope of the present subject matter and without diminishing its intended technical scope. It is therefore intended that such changes and modifications be covered by the appended claims.

The invention claimed is:

1. A gaming table component comprising:

a processor; and a memory device that stores a plurality of instructions that, when executed by the processor, cause the processor to:

prior to a play of a live table game occurring at a gaming table associated with the gaming table component and responsive to a game parameter modification event occurring in association with an outcome of a sporting event, wherein the sporting event is separate from the live table game, cause a display cause a display, by a display device, of a modified parameter of the live table game, responsive to no modified parameter of the live table game being associated with a game outcome for the play of the live table game, cause a display, by the display device, of the game outcome for the play of the live table game, wherein the game outcome for the play of the live table game occurs at the gaming table subsequent to and independent of the outcome of the sporting event, and responsive to the modified parameter of the live table game being associated with the game outcome for the play of the live table game, cause a display, by the display device, of a modified game outcome for the play of the live table game.

2. The gaming table component of claim 1, wherein when executed by the processor responsive to any modified parameter of the live table game being associated with a game award associated with the game outcome for the play of the live table game, the instructions cause the processor to cause a display, by the display device, of he a modified game award.

3. The gaming table component of claim 1, wherein the modified parameter of the live table game comprises an activated feature of the live table game.

4. The gaming table component of claim 1, wherein the live table game is associated with a designated sports team of the sporting event and the game parameter modification event occurs based on the outcome of the sporting event occurring in association with that designated sports team of the sporting event.

5. The gaming table component of claim 1, wherein the live table game is associated with a designated sporting event participant of the sporting event and the game parameter modification event occurs based on the outcome of the sporting event occurring in association with that designated sporting event participant of the sporting event.

6. The gaming table component of claim 1, wherein the outcome of the sporting event comprises an outcome of a portion of the sporting event.

7. The gaming table component of claim 1, wherein the sporting event is any of a live sporting event, a historic sporting event and an electronic sporting event.

8. The gaming table component of claim 1, wherein when executed by the processor, the instructions cause the processor to cause a display, by the display device, of the modified parameter of the live table game persisting until an event occurs in association with the sporting event.

9. The gaming table component of claim 1, wherein an amount of modification of the game parameter is based on the outcome of the sporting event.

10. The gaming table component of claim 1, wherein the game parameter modification event occurs in association with each player participating in the live table game.

11. A gaming table component comprising:

a processor; and a memory device that stores a plurality of instructions that, when executed by the processor responsive to a game parameter modification event occurring in association with a receipt, from a an outcome of a sporting event, cause the processor to:

cause a display, by a display device and, in association with a first player participating in a live table game occurring at a gaming table associated with the gaming table component, of a modification of a parameter of the live table game, wherein the live table game is separate and distinct from the sporting event, the modification, of the parameter of the live table game occurring independent of any modification of the parameter of the live table game associated with a second player participating in the live table game, for the first player participating in the live table game, cause a display, by the display device, of at least one of a first game outcome for the live table game, and a first game award associated with the first game outcome, wherein any of the first game outcome and the first game award are based, at least in part, on the displayed modification of the game parameter of the live table game, and for the second player participating in the live table game, cause a display, by the display device, of at least one of a second game outcome for the live table game, and a second game award associated with the second game outcome, wherein any of the second game outcome and the second game award are based, at least in part, on the game parameter of the live table game and independent of the displayed modification of the game parameter of the live table game.

12. A method of operating a gaming table component , the method comprising:

prior to a play of a live table game occurring at a gaming table associated with the gaming table component and responsive to a game parameter modification event occurring in association with an outcome of a sporting event, wherein the sporting event is separate from the live table game, display, by a display device a modified parameter of the live table game, responsive to no modified parameter of the live table game being associated with a game outcome for the play of the live table game, displaying, by the display device, the game outcome for the play of the live table game, wherein the game outcome for the play of the live table game occurs at the game table subsequent to and independent the outcome of the sporting event, and responsive to the modified parameter of the live table game being associated with the game outcome determined for the play of the live table game, displaying, by the display device, a modified game outcome for the play of the live table game.

13. The method of claim 12, further comprising, responsive to any modified parameter of the live table game being associated with a game award associated with the game outcome for the play of the live table game, displaying, by the display device, a modified game award.

14. The method of claim 12, wherein the modified parameter of the live table game comprises an activated feature of the live table game.

15. The method of claim 12, wherein the live table game is associated with a designated sports team of the sporting event and the game parameter modification event occurs based on the outcome of the sporting event occurring in association with that designated sports team of the sporting event.

16. The method of claim 12, wherein the live table game is associated with a designated sporting event participant of the sporting event and the game parameter modification event occurs based on the outcome of the sporting event occurring in association with that designated sporting event participant of the sporting event.

17. The method of claim 12, wherein the outcome of the sporting event comprises an outcome of a portion of the sporting event.

18. The method of claim 12, wherein the sporting event is any of a live sporting event, a historic sporting event and an electronic sporting event.

19. The method of claim 12, further comprising displaying, by the display device, the modified parameter of the live table game persisting until an event occurs in association with the sporting event.

20. The method of claim 12, wherein an amount of modification of the game parameter is based on the outcome of the sporting event.

* * * * *